US011220315B2

(12) United States Patent
Gadler

(10) Patent No.: US 11,220,315 B2
(45) **Date of Patent: *Jan. 11, 2022**

(54) BODY SURFING SUIT

(71) Applicant: WAVEWRECKER, LLC, El Cajon, CA (US)

(72) Inventor: Nicholas Noel Gadler, El Cajon, CA (US)

(73) Assignee: WAVEWRECKER, LLC, El Cajon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,413

(22) Filed: Jul. 29, 2019

(65) Prior Publication Data

US 2019/0344864 A1 Nov. 14, 2019

Related U.S. Application Data

(63) Continuation of application No. 15/290,952, filed on Oct. 11, 2016, now abandoned, which is a (Continued)

(51) Int. Cl.
*B63C 9/093* (2006.01)
*A41D 13/012* (2006.01)
(Continued)

(52) U.S. Cl.
CPC ..... *B63C 9/093* (2013.01); *A41D 13/012* (2013.01); *B63C 9/087* (2013.01); *B63C 9/115* (2013.01)

(58) Field of Classification Search
CPC ..... B63B 32/00; B63B 32/20; B63B 32/60; B63B 32/70; B63C 9/087; B63C 9/093;
(Continued)

(56) References Cited

U.S. PATENT DOCUMENTS 1,369,669 A 2/1921 Kamenos
1,675,372 A 7/1928 Mohr
(Continued)

FOREIGN PATENT DOCUMENTS

FR 2789651 A1 * 8/2000 ..... A41D 13/02
FR 3032865 A1 * 8/2016 ..... B63B 32/00
(Continued)

OTHER PUBLICATIONS

Extended European Search Report for related European Patent Application No. 14878730.2 dated Sep. 20, 2017 in 8 pages.
(Continued)

*Primary Examiner* — Ajay Vasudeva
(74) *Attorney, Agent, or Firm* — Procopio, Cory, Hargreaves & Savitch LLP

(57) ABSTRACT

Apparatus and methods for body surfing which provide the body surfer a means to stabilize his ride and control his direction/position on a wave are described herein. According to one aspect, a body surfing apparatus includes a body suit having a torso, arms, and legs; a plurality of fins located on the torso; a plurality of fins located on the arms; and one or more fins located laterally on the legs. The fins are preferably attached to the body suit via an adhesive or mechanical means and the fins and suit may include a buoyant layer. In one embodiment, the body surfing apparatus includes a body suit with multiple segmentations and/or fins with multiple sliced cuts.

16 Claims, 13 Drawing Sheets

Related U.S. Application Data continuation of application No. 14/158,465, filed on Jan. 17, 2014, now Pat. No. 9,493,218, which is a continuation-in-part of application No. 12/967,945, filed on Dec. 14, 2010, now Pat. No. 8,662,946.

(60) Provisional application No. 61/288,773, filed on Dec. 21, 2009.

(51) Int. Cl.
*B63C 9/087* (2006.01)
*B63C 9/115* (2006.01)

(58) Field of Classification Search
CPC ..... B63C 9/105; B63C 9/1055; B63C 9/115; A41D 13/012; A41D 13/0125
See application file for complete search history.

(56) References Cited

U.S. PATENT DOCUMENTS

| | | | | | |
|---|---|---|---|---|---|
| 2,851,707 | A | | 9/1958 | Samuels | |
| 3,179,963 | A | * | 4/1965 | Peterson | B63C 9/115 441/115 |
| 3,286,287 | A | * | 11/1966 | Martin | A63B 31/08 441/57 |
| 3,398,406 | A | | 8/1968 | Waterbury | |
| 3,803,652 | A | | 4/1974 | Uyehara | |
| D245,532 | S | | 8/1977 | Taylor | |
| 4,356,569 | A | * | 11/1982 | Sullivan | F41H 1/02 2/2.5 |
| 4,397,636 | A | | 8/1983 | Ganshaw et al. | |
| 4,602,384 | A | | 7/1986 | Schneider | |
| 4,710,978 | A | | 12/1987 | Pankopf et al. | |
| 5,013,271 | A | * | 5/1991 | Bartlett | A41D 13/0125 441/65 |
| 5,015,208 | A | | 5/1991 | Fox et al. | |
| 5,033,116 | A | | 7/1991 | Itagaki et al. | |
| 5,052,053 | A | | 10/1991 | Peart et al. | |
| 5,106,331 | A | * | 4/1992 | Lizarazu | B63B 32/50 441/55 |
| 5,173,068 | A | | 12/1992 | Dunn et al. | |
| 5,183,424 | A | | 2/1993 | Field | |
| 6,213,831 | B1 | | 4/2001 | Smith | |
| RE37,533 | E | | 1/2002 | Beige et al. | |
| 6,446,264 | B2 | | 9/2002 | Fairhurst et al. | |
| 7,252,625 | B1 | * | 8/2007 | Perka | A41D 13/0525 2/2.15 |
| 8,069,494 | B2 | | 12/2011 | Sundnes | |
| 8,095,996 | B2 | * | 1/2012 | Turner | A41D 13/0587 2/456 |
| 8,662,946 | B2 | | 3/2014 | Gadler | |
| 8,851,006 | B2 | | 10/2014 | Burga | |
| 9,056,662 | B2 | * | 6/2015 | Molyneux | B63C 11/04 |
| 9,493,218 | B2 | | 11/2016 | Gadler | |
| 2006/0073943 | A1 | | 4/2006 | Perka | |
| 2006/0089066 | A1 | | 4/2006 | Wilson | |
| 2008/0020660 | A1 | | 1/2008 | Barney | |
| 2011/0151733 | A1 | | 6/2011 | Gadler | |
| 2013/0031691 | A1 | | 2/2013 | Burga | |
| 2013/0217281 | A1 | * | 8/2013 | Gadler | B63C 9/115 441/115 |
| 2014/0134902 | A1 | | 5/2014 | Gadler | |

FOREIGN PATENT DOCUMENTS

| | | | |
|---|---|---|---|
| WO | 1992000123 | A1 | 1/1992 |
| WO | 1996007455 | A1 | 3/1996 |
| WO | 2011084424 | A2 | 7/2011 |
| WO | 2015108632 | A1 | 7/2015 |

OTHER PUBLICATIONS

First Examination Report for related New Zealand Patent Application No. 600463 dated Feb. 20, 2013, in 3 pages.
First Office Action for related Chinese Patent Application No. 201080016205.9 dated Aug. 15, 2012, in 9 pages.
First Office Action for related Mexican Patent Application No. MX/a/2012/007165 dated Oct. 1, 2014, in 2 pages.
International Search Report and Written Opinion for related PCT/US2010/060310 dated Aug. 31, 2011, in 10 pages.
International Search Report and Written Opinion for related PCT/US2014/069139 dated Apr. 13, 2015, in 22 pages.
International Search Report and Written Opinion for related PCT/US2016/062310 dated Dec. 28, 2016, in 7 pages.
Office Action for related Korean Patent Application No. 10-2011-7023271 dated Oct. 26, 2016 and corresponding English translation, in 10 pages.
Patent Examination Report No. 1 for related Australia Patent Application No. 2010340109 dated Apr. 7, 2014, in 4 pages.
U.S. Appl. No. 15/290,952, filed Oct. 11, 2016, Pending.
U.S. Appl. No. 14/158,465, filed Jan. 17, 2014, U.S. Pat. No. 9,493,218.
U.S. Appl. No. 12/967,945, filed Dec. 14, 2010, U.S. Pat. No. 8,662,946.

* cited by examiner

BODY SURFING SUIT

RELATED APPLICATIONS

This application is a continuation of U.S. patent application Ser. No. 15/290,952, filed Oct. 11, 2016, entitled "BODY SURFING SUIT", which is a continuation of U.S. patent application Ser. No. 14/158,465, filed Jan. 17, 2014 (now U.S. Pat. No. 9,493,218, issued Nov. 15, 2016) entitled "BODY SURFING SUIT", which is a continuation-in part of U.S. patent application Ser. No. 12/967,945, filed Dec. 14, 2010 (now U.S. Pat. No. 8,662,946, issued Mar. 4, 2014) entitled "BODY SURFING SUIT", which claims the benefit of U.S. Provisional Patent Application No. 61/288,773, filed Dec. 21, 2009, entitled "BODY SURFING SUIT", all of which are incorporated herein by reference in their entirety as if set forth in full.

FIELD OF THE INVENTION

The present invention relates, in general, to body surfing, and more particularly to a body surfing suit. More particularly, the present invention relates to a buoyant body suit that also improves velocity and directional control in the water.

BACKGROUND OF THE INVENTION

Body surfing is a way to enjoy the thrill of riding a wave. Body surfers, generally, simply extend their bodies horizontally, projecting their arms forward and in line with their body while allowing a breaking wave to drive them shoreward with the surf. To the body surfer, it is important to be able to ride waves of varied sizes, to enjoy a stable ride and to be able to control direction and position on a wave face. Since a body surfer rarely uses any equipment other than swim fins, it is quite difficult for a body surfer to adequately control the stability of his ride and control his direction and position on a wave face.

For a body surfing suit to work in real life, bending is key (to allow for swimming), and buoyancy in the correct location(s) is also key. It is preferable to have a buoyancy gradient that is greatest (e.g., most buoyant) at the surfer's head and tapers down toward the feet to ensure that the surfer does not plow and tumble face first.

A few body surfing suits can be found in the prior art. For example, U.S. Pat. No. 5,106,331 to Lizarazu discloses a body surfing apparatus having a garment with a rigid outer shell attached to the torso portion of the garment and an inner buoyant unit underneath the torso portion of the garment. The rigid outer shell and inner buoyant unit make up a laminated multi-layered abdominal-chest plate. The shape of the abdominal-chest plate is contoured to cover the abdomen and extend upward into the central portion of the chest. This has two major problems: (1) the chest plate does not allow adequate forward bending because the rigidity of the laminated structure is not anatomically designed to allow full bending where the body actually bends (namely, the ribcage needs to be separate from the abdomen or it severely limits bending which one needs to swim properly) and (2) the suit puts the buoyant material in the wrong place, e.g., front center of the body, which results in plowing.

Additionally, the Lizarazu body surfing suit includes a number of fins located on the rigid outer shell and on the arms and legs of the suit. The arm fins are positioned on the upper arm region, are shaped incorrectly to be functional, and the lack of smooth edge detail causes a lot of drag. The arm fins do not likely provide buoyancy, but are rather present for stability. The legs fins suffer from similar problems as the arm fins and are present only for stability.

U.S. Pat. No. 5,013,271 to Bartlett discloses a body surfing suit having buoyant material placed on the chest and in various channels located on the legs of the suit. The Bartlett body surfing suit suffers from the following problems: (1) The buoyant material is incorrectly placed anteriorly and the main component includes coverage of the chest and abdomen in one piece; this makes the suit too rigid to allow adequate bending/tucking forward which is almost a requirement when maneuvering in the water to consistently catch waves. (2) In the upper chest and back region, the buoyant material is positioned both on the front and back of the suit in pad-like structures, but is not contoured anatomically and offers little benefit beyond adding some buoyancy. The back pads are simply buoyant areas without defined, streamlined 3-D contours. (3) The upper pointed regions of the chest piece extend out near the shoulder. These points impede anterior movement of the arm during the swimming stroke. (4) The suit does not have fins to aid in stability.

The present invention seeks to overcome these limitations by providing the body surfer a means to stabilize his ride and control his direction/position on a wave.

SUMMARY

Apparatus and methods for body surfing which provide the body surfer a means to stabilize his ride and control his direction/position on a wave are described herein.

According to one aspect, a body surfing apparatus includes a body suit having a torso and legs; a plurality of fins and/or rails located on the torso including the chest; one or more fins located on the legs; and one or more fins located on the arms. The fins are preferably either built into the suit, or created to be removable and interchangeable. The fins may be attached to the body suit via an adhesive or mechanical means such as, but not limited to, Velcro® attachment. The suit may include a base layer, such as, but not limited to, Neoprene.

According to another aspect, the body surfing suit may include segmented sections which may act as control surfaces, planning elements, buoyancy elements, or a combination. The segmented sections, in one embodiment, divide the body surfing suit into a chest segmentation, an abdominal segmentation, a pelvic segmentation, and a thigh segmentation. In another embodiment, the segmentations are further divided into more segmentations. The segmented sections may also include fins.

BRIEF DESCRIPTION OF THE DRAWINGS

The accompanying drawings, which are incorporated in and constitute a part of the specification, illustrate embodiments of the invention, and together with the description, serve to explain the objects, advantages, and principles of the invention. In the drawings.

DETAILED DESCRIPTION OF PREFERRED EMBODIMENTS

After reading this description it will become apparent to one skilled in the art how to implement the invention in various alternative embodiments and alternative applications. However, all the various embodiments of the present invention will be described herein, it is understood that these embodiments are presented by way of an example only, and not limitation. As such, this detailed description of various alternative embodiments should not be construed to limit the scope or breadth of the present invention as set forth below.

Anatomical reference planes and directions may be defined as follows. The sagittal plane is a longitudinal plane that divides the body into a right and left hemisphere (or in some instances, be defined as a central axis of the body). The frontal plane is also a longitudinal plane but is perpendicular to the sagittal plane and divides the body into anterior (front) and posterior (back) hemispheres. The traverse plane is a latitudinal plane that divides the body into superior (upper) and inferior (lower) hemispheres. The anterior direction refers to the front of the body, and the posterior direction refers to the rear of the body. The distal direction refers to the direction away from the origin, and the proximal direction refers to the direction towards the origin. The dorsal direction refers to the upper surface of the body or towards the back of the body, and the ventral direction refers to the lower surface of the body or towards the stomach. The lateral direction refers to the side of the body or away from the sagittal plane, and the medial direction refers to the middle of the body or towards the sagittal plane. The rostral direction refers to the direction towards the front of the body, and the caudal direction refers to the direction towards the back of the body or towards the tail. Objects superior compared to other objects refer to being above or over the other object, while objects inferior compared to other object objects refer to being below or under the other object.

In multiple embodiments, the parts of the body may be defined as follow. The arm is defined as the part of the upper limb between the shoulder and the elbow joint, and the forearm is defined as the segment between the elbow and the wrist. The thoracic region is defined as the region of the chest from the thoracic inlet to the thoracic diaphragm. The abdominal region is defined as the region from the thoracic diaphragm to the pelvic inlet (pelvic brim). The upper leg is defined as the region from the inguinal ligament to the knee. The lower leg is defined as the region from the knee to the ankle.

Figure 1:
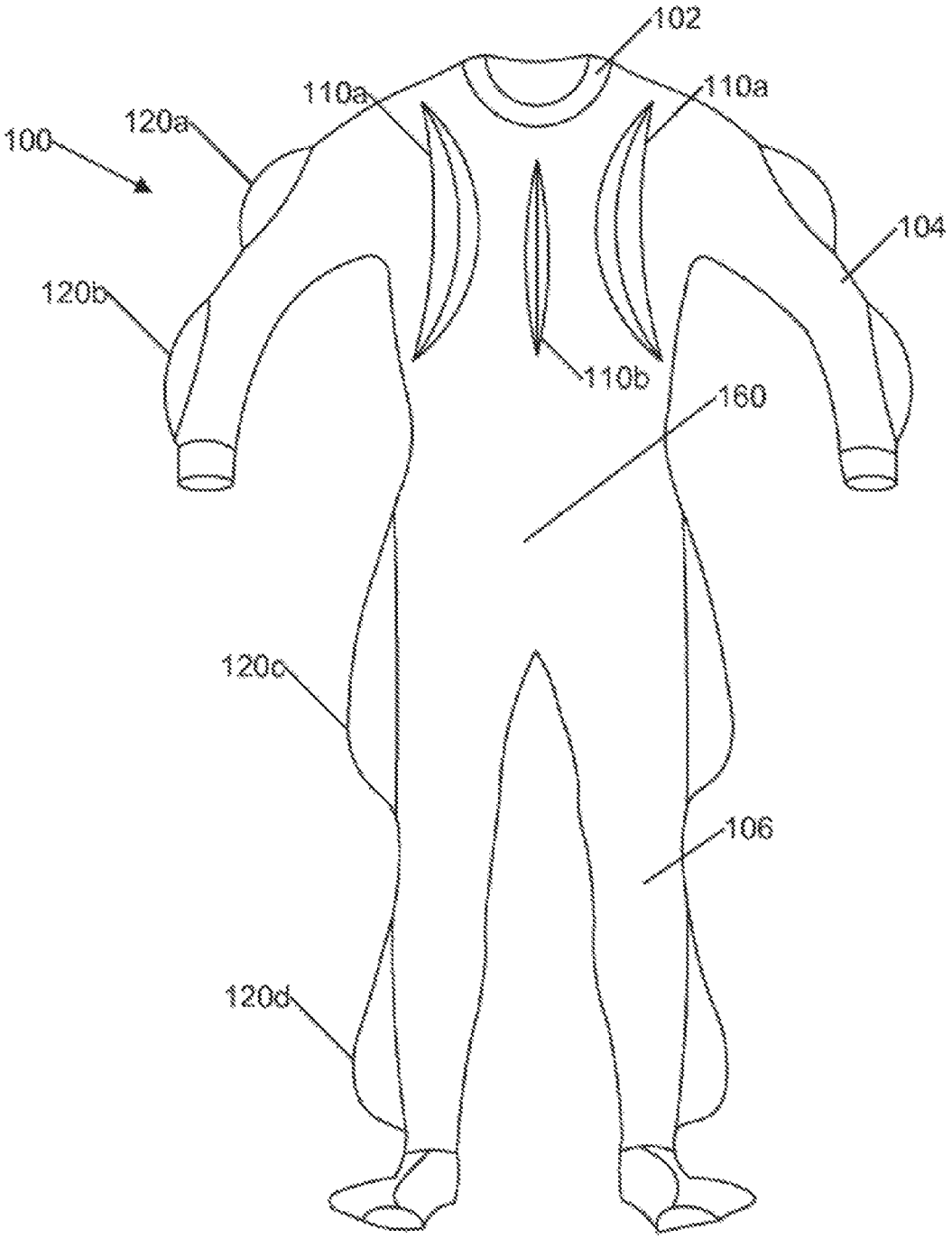
FIG. 1 is a front view of a body surfing suit in accordance with an embodiment of the invention.
Figure 2:
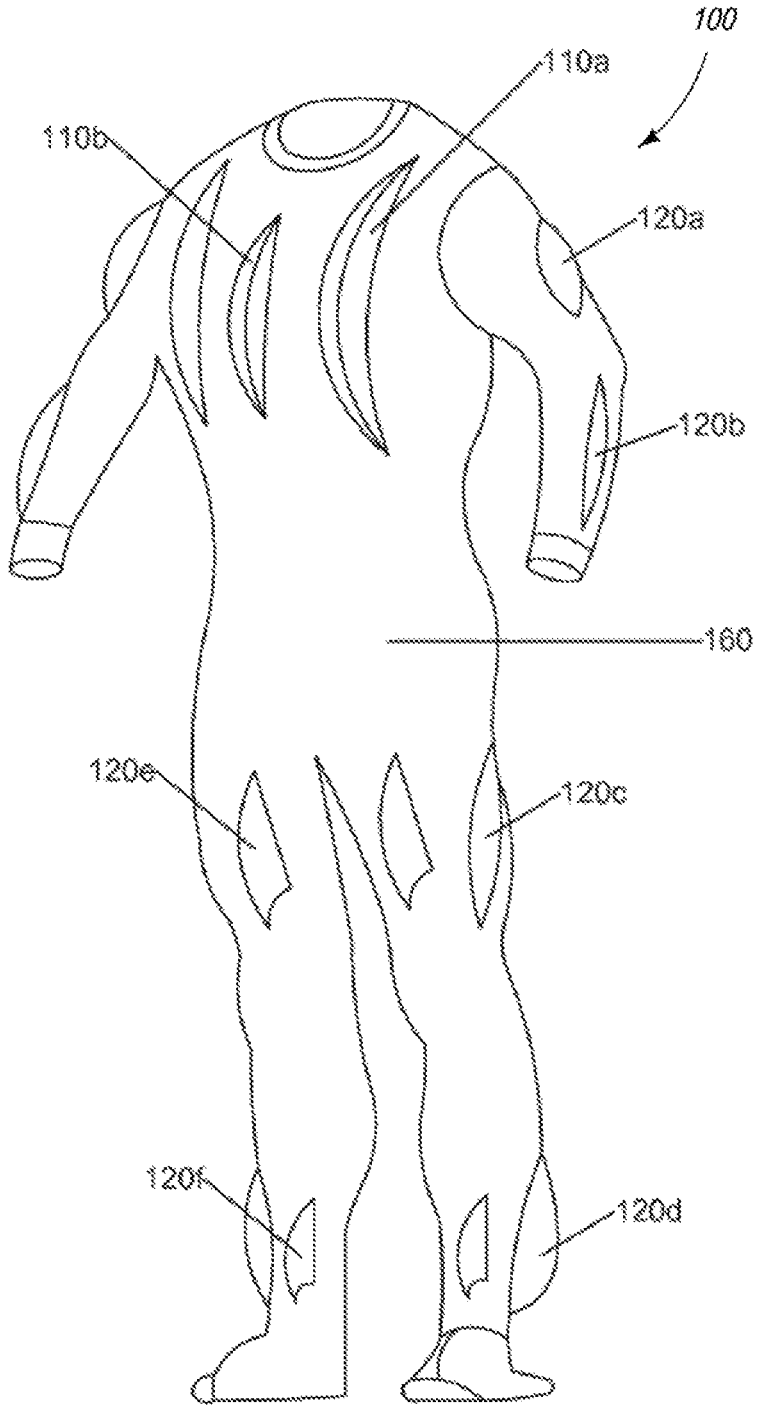
FIG. 2 is a side view of a body surfing suit in accordance with an embodiment of the invention.
Figure 3:
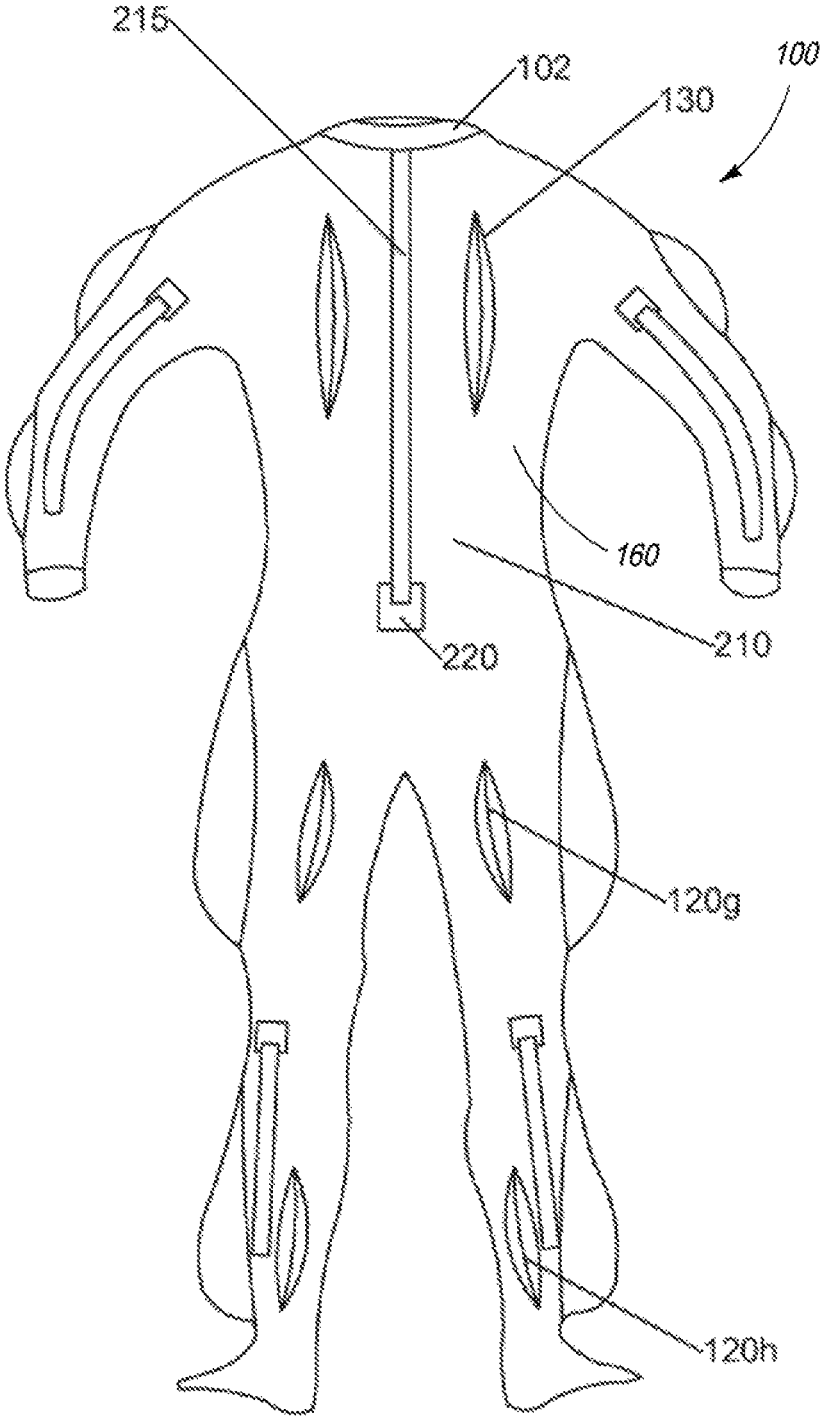
FIG. 3 is a rear view of a body surfing suit in accordance with an embodiment of the invention.
Figure 5:
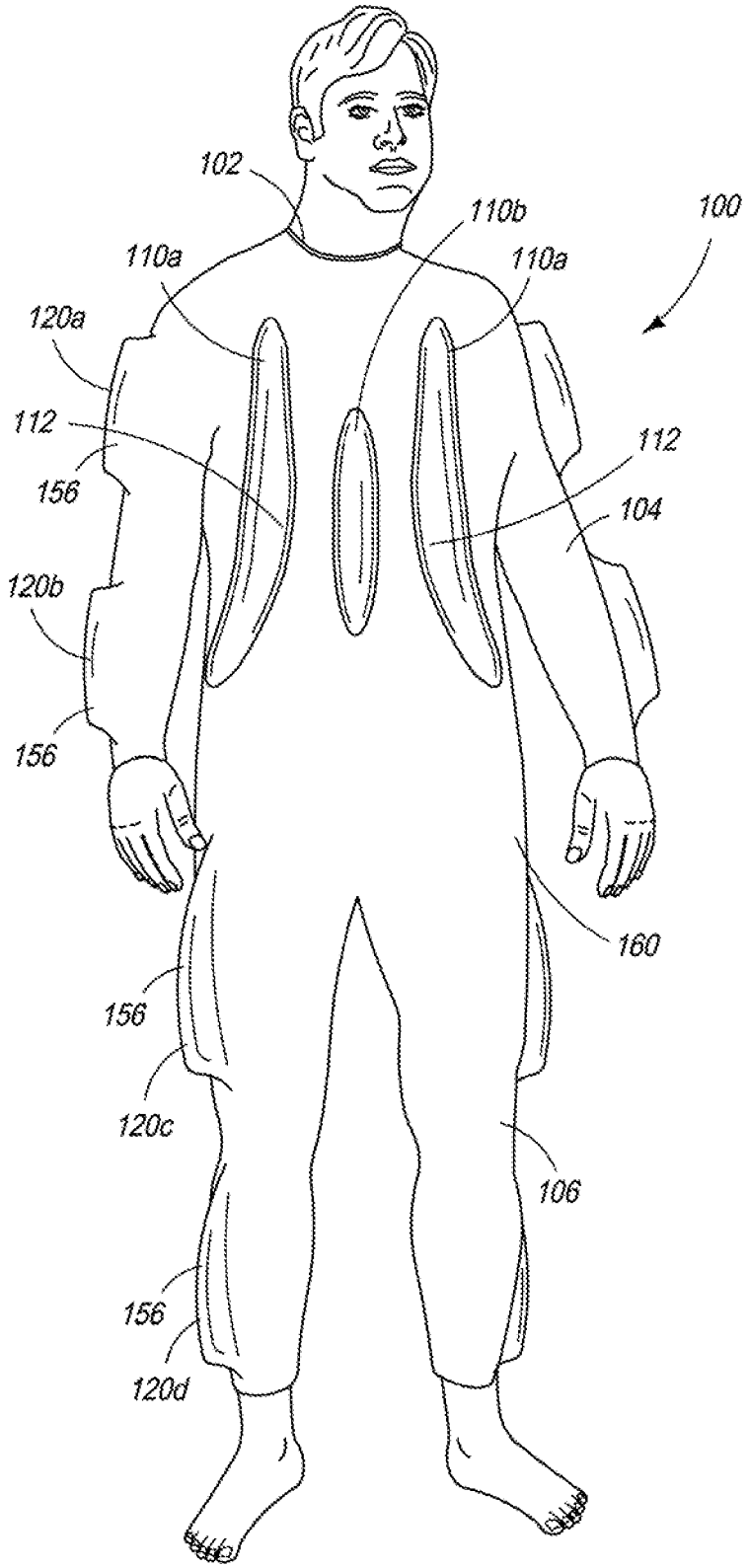
FIG. 5 is a perspective view of a body surfing suit in an embodiment including three chest fins, arm fins and lateral leg fins, in accordance with the invention.

FIG. 5 depicts an embodiment of the body surfing suit 100 shown in a prospective view. As shown in the figure, body surfing suit 100 includes a body 160, a collar 102, a pair of sleeves 104, a pair of legs 106, a pair of lateral chest fins 110*a*, a center chest fin 110*b*, a pair of upper arm fins 120*a*, a pair of lower arm fins 120*b*, a pair of upper lateral leg fins 120*c*, and a pair of lower lateral leg fins 120*d*. Fins may comprise a blade portion including a wider base narrowing to an apex at the top of the blade portion. The blade of each fin may provide a directional control surface and/or a buoyancy element. Sleeves 104 and/or legs 106 may be short or long. In some embodiments, sleeves 104 may not be necessary. However, when used with fasteners (discussed below), sleeves 104 are preferably long, as shown in FIGS. 1-3.

Body 160 of body surfing suit 100 is preferably constructed from Neoprene® or other lightweight, stretchable, water, chemical and UV resistant material. Neoprene®, also known as polychloroprene, is part of a family known as synthetic rubbers or plastics. For example, this underlay/undergarment material of suit 100 may be fabricated from Neoprene® in various thicknesses. A thicker Neoprene® suit provides more buoyancy and allows a surfer to body surf in colder waters (e.g., East Coast) since Neoprene® keeps the body temperature elevated. In some embodiments, an off-the-shelf wetsuit may be used for body surfing suit 100. In other embodiments, the body surfing suit 100 may be constructed from polyvinyl chloride ("PVC"), ethylene vinyl acetate ("EVA"), cross-linked polyethylene, cross-linked polyolefin, and polyurethane. Other materials may include plastic, fiberglass, IXL foam, fiberclad, phuzion, high density polyethylene (HDPE), polystyrene, Lycra®, Volara elastopolymer, and polyethylene.

For example, for those applications which expose the body to temperature differences, such as those associated with diving, the Neoprene® suit may be manufactured by foaming the Neoprene® plastic with an inert nitrogen gas. When placed in the presence of nitrogen gas being foamed into the Neoprene® material, tiny enclosed bubbles create voids in the material which reduce the surface area covered. These bubbles also help reduce the density of the material, allowing it to be much more buoyant. The buoyancy factor is quite helpful when used in wakeboarding, surfing and snorkeling applications.

As shown in FIG. 5, lateral chest fins (or rails) 110*a* may extend approximately from the shoulder area to slightly lower than the bottom of the rib cage of the user. The lateral chest fins 110*a* may curve down the torso and curve outwards towards the side of the torso in a complex 3-D shape. The lateral chest fins 110*a* may also include a lateral bend 112 beginning at the superior end of the fin, or some distance from the superior end of the fin, and extending to the inferior end of the fin. In some embodiments, the lateral bend 112 begins at the most superior end of the lateral chest fin 110*a* and extends all the way down. In some embodiments, the lateral bend 112 may begin about half way down the lateral chest fin 110*a* in the inferior direction. In some embodiments, the lateral bend 112 may begin about one third down the lateral chest fin 110*a* in the inferior direction. In some embodiments, the lateral bend 112 may begin about one quarter down the lateral chest fin 110*a* in the inferior direction. The lateral bend 112 may curve in an inferior/lateral direction down the side of the torso. In some embodiments, the lateral bend 112 may be at an angle between 0 degrees to 45 degrees relative to the sagittal plane (or the central axis of the user's body). In some embodiments, the lateral bend 112 may be at an angle between 15 degrees to 30 degrees relative to the sagittal plane (or the central axis of the user's body). In some embodiments, the lateral bend 112 may be at an angle at about a 30 degree angle relative to the sagittal plane (or the central axis of the user's body). The angle of the lateral bend 112 may allow the lateral chest fin 110*a* to not interfere with a user's swimming stroke. In some embodiments, the lateral bend 112 may be adjacent to a chest wall of the chest of the user or of the body suit.

In some embodiments, the lateral chest fins 110*a* start out at the midpoint of the clavicle and continue downward and laterally across the breast and ending at the inferior, lateral extent of the ribcage. The lateral chest fins 110 may have a cambered shape. The lateral chest fins 110*a* may be designed to completely avoid the axillary region of the user's body which would prevent interference with the arm stroke. This complex 3-D shape with a slight twist allows the body of the surfer to bend anatomically and does not impede any of the bending movement. The force of bending is directed laterally and the force unloads laterally allowing the bending to occur unimpeded. In some embodiments, the chest fins are thicker at the base (proximate to body 160) and taper upward to a rounded, e.g., dolphin dorsal-like fin, point at the top or edge. Both lateral chest fins 110*a* and center chest fin 110*b* preferably aid in gripping the side of a wave, provide directional stability, and aid in preventing yaw and roll.

Movement associated with the human body occurs in accordance with the Orthopedic Prosthetic Function principles wherein the human body is composed of multiple functional segments. These segments may work independently or in concert with one another in a coordinated fashion to provide human locomotion and/or functional work and movement. There are critical anatomic functional segments which must retain full range of motion (ROM) or the user's swimming stroke will be vastly impaired. The critical areas are the head and neck, the upper arms, the lower arms and wrists, the axilla, the thorax, the abdomen, the trunk, the upper legs, the lower legs, and ankles. All of the chest fins conform precisely to the underlying anatomy and do not violate the functional anatomic segments (i.e. they do not bind or tie two or more adjacent anatomic segments together such as the thorax and abdomen). As a result full range of motion (ROM) critical to swimming is retained.

Additional functions of the lateral chest fins may include user stability in the water and spreading out the buoyancy laterally. These lateral chest fins are constructed to bend and flex with the movement of the user. These lateral chest fins are not rigid. The lateral chest fins may also function as a unit with the center chest fin to significantly enhance anterior buoyancy. For buoyancy to be effective it must be properly positioned circumferentially around the body (anteriorly-posteriorly, side to side, & superior-inferiorly) in just the right amounts while avoiding impingement of critical anatomic moving segments. This buoyancy may be referred to as functional buoyancy hereinafter. Functional buoyancy may be critical to orient the user in a head-up and front-lying position. Chest fins may be placed in locations for optimum buoyancy while still avoiding interference with a swimming stroke. In some embodiments, the chest fins augment propulsion and improve the swimming stroke to displace more water propelling the surfer faster and more efficiently, while giving the surfer directional control on the wave throughout the ride. All of the fins in the body surfing suit may be placed in positions to allow for buoyancy balance while also not interfering with swimming strokes. Furthermore, the fins may combine buoyancy, enhanced contour (improves human shape to be more streamlined as well as giving directional control), and flexibility to allow for freedom of movement.

In some embodiments, the lateral chest fins 110*a* are about 2-170 millimeters wide at the base and taper up to about a 1-40 millimeter wide rounded point at the top or edge. In a preferred embodiment, lateral chest fins 110*a* are about 100 millimeters wide at the base and taper up to about a 15 millimeter wide rounded point at the top or edge. In some embodiments, lateral chest fins 110*a* are about 10-300 millimeters tall, e.g., from base to edge. In a preferred embodiment, lateral chest fins 110*a* are about 35 millimeters tall.

In some embodiments, center chest fin 110*b* is about 2-150 millimeters wide at the base and tapers up to about a 1-40 millimeter wide rounded point at the top or edge. In a preferred embodiment, center chest fin 110*b* is about 80 millimeters wide at the base and tapers up to about a 15 millimeter wide rounded point at the top or edge. In some embodiments, center chest fin 110*b* is about 10-300 millimeters tall. In a preferred embodiment, center chest fin 110*b* is about 35 millimeters tall.

The center chest fin 110*b* may be anatomically contoured to the underlying sternum right in the midline of the chest. The center chest fin may extend from the manubrium to the xiphoid process. In some embodiments, the center chest fin 110*b* does not encroach onto the abdominal anatomic segment. The center chest fin may be contoured specifically to allow full movement of the ribcage including bending and rotation without interfering with the user's swimming stroke or movement in the water. While in the water, the center chest fin may provide center buoyancy and center directional control. Furthermore, the center chest fin may provide a superior-inferior buoyancy gradient which allows for a head up tilt to the user. In some embodiments, the combination of the volume of air within the user's lungs, the fat content of the chest and abdomen, and the chest fins (center and lateral) may provide the superior-inferior buoyancy gradient. The head up tilt may be critical to catching and maintaining a wave. In some embodiments, this head up tilt may help prevent head or neck injuries.

Body surfing suit 100 also includes a plurality of fins or skeggs located on at least the sleeves 104 and/or legs 106 of body 160. As shown in FIG. 5, an upper arm fin 120*a* is located laterally on the upper arm region and a lower arm fin 120*b* is located laterally on the lower arm region. In some embodiments, the upper arm fins 120*a* are about 2-120 millimeters wide at the base and taper up to about a 1-40 millimeter wide rounded point at the top or edge. In a preferred embodiment, upper arm fins 120*a* are about 45 millimeters wide at the base and taper up to about a 5 millimeter wide rounded point at the top or edge. In some embodiments, upper arm fins 120*a* are about 10-200 millimeters tall, e.g., from base to edge. In a preferred embodiment, upper arm fins 120*a* are about 45 millimeters tall.

The upper arm fins 120*a* may be positioned anteriorly, posteriorly, or centered at the midpoint of the arm front to back. Preferably, however, the upper arm fins 120*a* may be located on the lateral aspect of the arm midway between the shoulder and the elbow. In such a position, the upper arm fins 120*a* would not impede the user during an arm stroke. The upper arm fins 120*a* are of a blade shape and augment the anatomy of the upper lateral arm to enable the user to stick out the arm onto the face of a wave to grip the water and guide the user. In particular, the upper arm fin 120*a* may be useful when a user wishes to catch the face of a wave. For example, the user may put out his left arm into the face of the wave and the blade 156 of the upper left arm fin 120*a* will catch the wave and propel and/or hold the user in the direction of the wave. This could be called leading with the arm. Another method of using the arm fins is when the arms are held at the sides of the body and then the shoulders rolled anteriorly and forward, the upper arm fins 120*a* may create a water foil beneath the user. This may cause an inferior vortex underneath the rider to propel the user forward along the wave with almost no effort by the user. This could be called leading with the head. In some embodiments, the lateral placement of the upper arm fins 120*a* allows for an anterior-posterior neutral buoyancy. This may allow for more balanced swimming or body surfing.

In some embodiments, the lower arm fins 120*b* are about 2-100 millimeters wide at the base and taper up to about a 1-40 millimeter wide rounded point at the top or edge. The lower arm fins 120*b* may be positioned anteriorly, posteriorly, or centered at the midpoint of the arm front to back. Preferably, however, the lower arm fins 120*b* are centered laterally at the mid-portion of the forearm, between the wrist and the elbow, front to back. In a preferred embodiment, the lower arm fins 120*b* are about 45 millimeters wide at the base and taper up to about a 5 millimeter wide rounded point at the top or edge. In some embodiments, lower arm fins 120*b* are about 10-200 millimeters tall. In a preferred embodiment, lower arm fins 120*b* are about 45 millimeters tall. In some embodiments, the lower arm fins 120*b* may be placed on the lateral aspect of the arm midway between the elbow and the wrist. In such a position, the lower arm fin would not impede the user during an arm stroke. The lower arm fins allow for similar swimming and surfing functionality as the upper arm fins described above.

Also, as shown in FIG. 5, a lower lateral leg fin 120*d* is located laterally on each shin and an upper lateral leg fin 120*c* is located laterally on each thigh of body 160. The upper lateral leg fins 120*c* preferably extend from the pelvis region of the surfer to the top of the knee. In some embodiments, the upper lateral leg fins 120*c* are about 10-250 millimeters wide at the base and taper up to about a 1-40 millimeter wide rounded point at the top or edge. The upper lateral leg fins 120*c* may be positioned anteriorly, posteriorly, or centered at the mid-portion of the thigh front to back. Preferably, however, the upper lateral leg fins 120*c* are centered at the mid-portion of the thigh, front to back. In a preferred embodiment, the upper lateral leg fins 120*c* are about 100 millimeters wide at the base and taper up to about a 15 millimeter wide rounded point at the top or edge. In some embodiments, upper lateral leg fins 120*c* are about 10-250 millimeters tall. In a preferred embodiment, upper lateral leg fins 120*c* are about 85 millimeters tall.

The upper lateral leg fins 120*c* may be contoured precisely to the underlying anatomy of the upper leg. The upper lateral leg fins 120*c* may extend from the top of the iliac crest laterally downward to just above the knee. The top of the upper lateral leg fin 120*c* may be contoured at a low height so as not to interfere with the hand during a swimming stroke. In some embodiments, the upper lateral leg fin 120*c* is shaped like a dolphin fin. The upper lateral leg fin 120*c* may increase in height as it extends inferiorly down the leg and then taper down at the inferior aspect. The upper lateral leg fin 120*c* may create a torpedo-like shape to the body surfing suit 100 and create a more streamline effect. This may increase water displacement during a kicking stroke which would result in greater propulsion through the water. The upper lateral leg fins 120*c* may also provide greater stability. In some embodiments, the upper lateral leg fins provide buoyancy to the upper leg but still maintain an anterior-posterior neutral buoyancy.

The lower lateral leg fins 120*d* preferably extend from the lower aspect of the tibial plateau (e.g., shin) of the surfer to the ankle. In some embodiments, the lower lateral leg fins 120*d* are about 10-150 millimeters wide at the base and taper up to about a 1-40 millimeter wide rounded point at the top or edge. The lower lateral leg fins 120*d* may be positioned anteriorly, posteriorly, or centered at the midpoint of the shin front to back. Preferably, however, the lower lateral leg fins 120*d* are centered at the mid-portion of the shin, front to back. In a preferred embodiment, the lower lateral leg fins 120*d* are about 50 millimeters wide at the base and taper up to about a 15 millimeter wide rounded point at the top or edge. In some embodiments, lower lateral leg fins 120*d* are about 10-250 millimeters tall. In a preferred embodiment, lower lateral leg fins 120*d* are about 90 millimeters tall. In some embodiments, lower lateral leg fins 120*d* may aid in propulsion through the water, thereby reducing or eliminating the need for the surfer to wear fins on his feet.

The lower lateral leg fins 120*d* may be contoured precisely to the underlying anatomy of the lower leg. The lower lateral leg fins 120*d* may extend from just below the knee laterally downward to just above the ankle bone. The top of the lower lateral leg fin 120*d* may comprise a shape similar to the upper lateral leg fin 120*c*. The lower lateral leg fin 120*d* may increase in height as it extends inferiorly down the leg and then taper down at the inferior aspect. Furthermore, the lower lateral leg fins 120*d* may provide the same functions as the upper lateral leg fins described above.

As shown in FIG. 2, some embodiments of a body surfing suit feature a central shin fin 120*f* located centrally on each shin and a central thigh fin 120*e* located centrally on each thigh of body 160. In some embodiments, the central thigh fins 120*e* are about 5-120 millimeters wide at the base and taper up to about a 1-30 millimeter wide rounded point at the top or edge. These fins may be placed anywhere on the anterior thigh region, but preferably, the central thigh fins 120*e* are centered at the mid-portion of the thigh, side to side. In a preferred embodiment, the central thigh fins 120*e* are about 60 millimeters wide at the base and taper up to about a 5 millimeter wide rounded point at the top or edge. In some embodiments, central thigh fins 120*e* are about 5-250 millimeters tall. In a preferred embodiment, central thigh fins 120*e* are about 100 millimeters tall.

In some embodiments, the central shin fins 120*f* are about 5-120 millimeters wide at the base and taper up to about a 1-30 millimeter wide rounded point at the top or edge. These fins may be placed anywhere on the anterior shin region, but preferably, the central shin fins 120*f* are centered at the mid-portion of the shin, side to side. In a preferred embodiment, the central shin fins 120*f* are about 50 millimeters wide at the base and taper up to about a 5 millimeter wide rounded point at the top or edge. In some embodiments, central shin fins 120*f* are about 5-250 millimeters tall. In a preferred embodiment, central shin fins 120*f* are about 110 millimeters tall.

Referring to FIG. 3, which is a back view of the body surfing suit 100 of FIG. 2, in some embodiments a central calf fin 120*h* is located centrally on each calf and a central hamstring fin 120*g* is located centrally on each hamstring of body 160. In some embodiments, the central hamstring fins 120*g* are about 5-120 millimeters wide at the base and taper up to about a 2-30 millimeter wide rounded point at the top or edge. These fins may be placed anywhere medial-lateral on the hamstring area, but preferably, the central hamstring fins 120*g* are centered at the mid-portion of the hamstring, side to side. In a preferred embodiment, the central hamstring fins 120*g* are about 60 millimeters wide at the base and taper up to about a 5 millimeter wide rounded point at the top or edge. In some embodiments, central hamstring fins 120*g* are about 5-250 millimeters tall. In a preferred embodiment, central hamstring fins 120*g* are about 100 millimeters tall.

In some embodiments, the central calf fins 120*h* are about 5-120 millimeters wide at the base and taper up to about a 1-30 millimeter wide rounded point at the top or edge. These fins may be placed anywhere medial-lateral on the calf region, but preferably, the central calf fins 120*h* are centered at the mid-portion of the calf, side to side. In a preferred embodiment, the central calf fins 120*h* are about 30 millimeters wide at the base and taper up to about a 5 millimeter wide rounded point at the top or edge. In some embodiments, central calf fins 120*h* are about 5-250 millimeters tall. In a preferred embodiment, central calf fins 120*h* are about 100 millimeters tall.

As shown in FIG. 3, some embodiments of body surfing suit 100 also include a plurality of dorsal fins 130. In some embodiments, body surfing suit 100 includes one or more dorsal fins. As shown, suit 100 includes two dorsal fins 130 located on the shoulder blades of the surfer. In some embodiments, the dorsal fins 130 are about 10-200 millimeters wide at the base and taper up to about a 1-40 millimeter wide rounded point at the top or edge. In a preferred embodiment, the dorsal fins 130 are about 80 millimeters wide at the base and taper up to about a 10-15 millimeter wide rounded point at the top or edge. In some embodiments, dorsal fins 130 are about 10-300 millimeters tall. In a preferred embodiment, dorsal fins 130 are about 35 millimeters tall.

In some embodiments, body surfing suits include only a torso and sleeves, featuring only chest fins, arm fins, or a combination of both. In other embodiments, body surfing suits include only legs, featuring only upper leg fins, lower leg fins, or a combination of both.

Also as shown in FIG. 3, body surfing suit 100 includes a plurality of fasteners 210 located on the posterior of the suit to keep body surfing suit 100 on the surfer. In one embodiment, fasteners 210 are zippers 215. A fastener 210 is preferably located on at least the torso of the body surfing suit 100, extending from the collar 102 to the rump. Additionally, a plurality of fasteners 210 may be located on each of the limbs, such as extending from mid-calf down to the ankle on the legs and extending from elbow down to the wrist on the arms. In cases where fins and fasteners are located on the same limbs, the fins are generally centered on the limb and the fasteners are generally off-center. When fastener 210 is a zipper 215, reinforcement areas or patches 220 may be desirable. These reinforcement areas 220 are usually located at the terminal end of the fastener 210. Also, reinforcement areas 220 may be fabricated from any suitable material known to make a zipper stronger and resist failure.

Additional fasteners may be used to keep body surfing suit 100 on the surfer. For example, fasteners (not shown) may be included at the ends of the limbs of suit 100. On the legs, fasteners may be stirrups; stirrups would allow the suit 100 to be pulled down and maintained in a proper position. On the arms, fasteners (not shown) may be finger rings. It is envisioned that as few as one or as many as five finger rings may be used in each fastener. Finger rings would aid in securing the suit 100 to the hand of the surfer, keeping the correct position of the suit in the lateral to medial directions.

Alternatively, in some embodiments, the hand of the surfer is encased by a glove (not shown) that is integral to suit 100. The glove may additionally be webbed, such that the hand of the surfer looks like a frog or duck foot when worn. These webbed gloves may be made of a thin spandex material so that it easily opens and collapses. In other embodiments, the webbed gloves will have cutoff finger tips to allow for size discrepancies.

Figure 4:
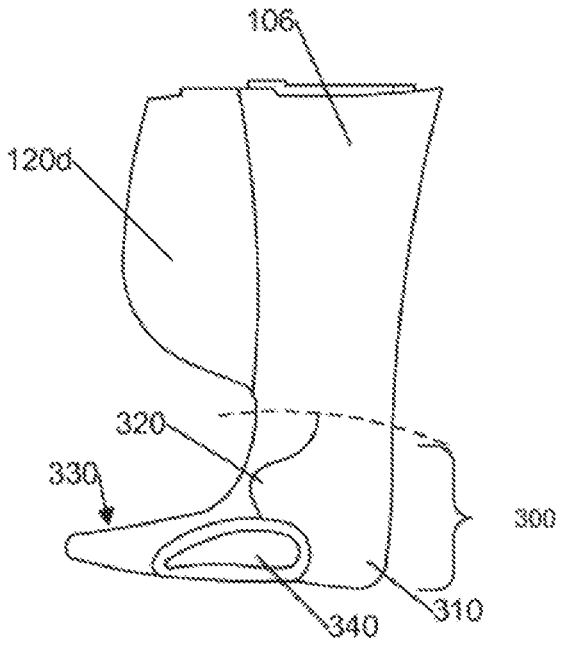
FIG. 4 is a front view of the booties of a body surfing suit accessory in accordance with an embodiment of the invention.

Referring now to FIG. 4, a body surfing accessory, booties 300 are shown. Booties 300 include a body portion 310 and a plurality of fins 320, 330. Body portion 310 preferably covers the ankle of the surfer and the foot of the surfer, with an opening 340 allowing the surfer's toes to be exposed. In a preferred embodiment, fin 330 represents a lateral foot fin (e.g., lateral to the foot) and fin 320 represents a top foot fin.

In some embodiments, the lateral foot fins 330 have a rounded front and taper backward in a curved arc. Lateral foot fins 330 preferably start at the base of the little toe and come forward slightly, then round at the front extending laterally about 10-300 millimeters. In a preferred embodiment, the lateral foot fins 330 extend laterally about 150 millimeters. Lateral foot fins 330 preferably are about 10-100 millimeters wide at the top of the foot tapering down to about 1-30 millimeters laterally. In a preferred embodiment, lateral foot fins 330 are about 40 millimeters wide at the top of the foot tapering down to about 15 millimeters laterally.

In some embodiments, booties 300 are fabricated from Neoprene®. As such, the booties 300 should easily slide onto the surfer's feet and complement suit 100. In a preferred embodiment, there is about a 35-millimeter Neoprene® section transition from the ankle to the foot which will stretch to allow for size discrepancies in wearers.

In some embodiments, the body surfing suit may comprise only a torso section and arms. In some embodiments, the body surfing suit may be an article of recreational clothing comprising a body including a torso, a collar, a pair of arms, and one or more fins. The torso may include a chest region and a shoulder region, and the arms may include an elbow region and a wrist region. The shoulder region may include a lower end, the elbow region may include an upper end and a lower end, and the wrist region may include an upper end. The fins of such an embodiment may include: one or more upper arm fins, wherein each upper arm fin extends from the lower end of the shoulder region to the upper end of the elbow region, and wherein each upper arm fin includes a blade portion. The fins may also include: one or more lower arm fins, wherein each lower arm fin extends from the lower end of the elbow region to the upper end of the wrist region, and wherein each lower arm fin includes a blade portion. The fins may also include: one or more chest fins located in the chest region, wherein the chest fins may include two lateral chest fins and a center chest fin, and wherein each chest fin includes a blade portion.

Figure 6:
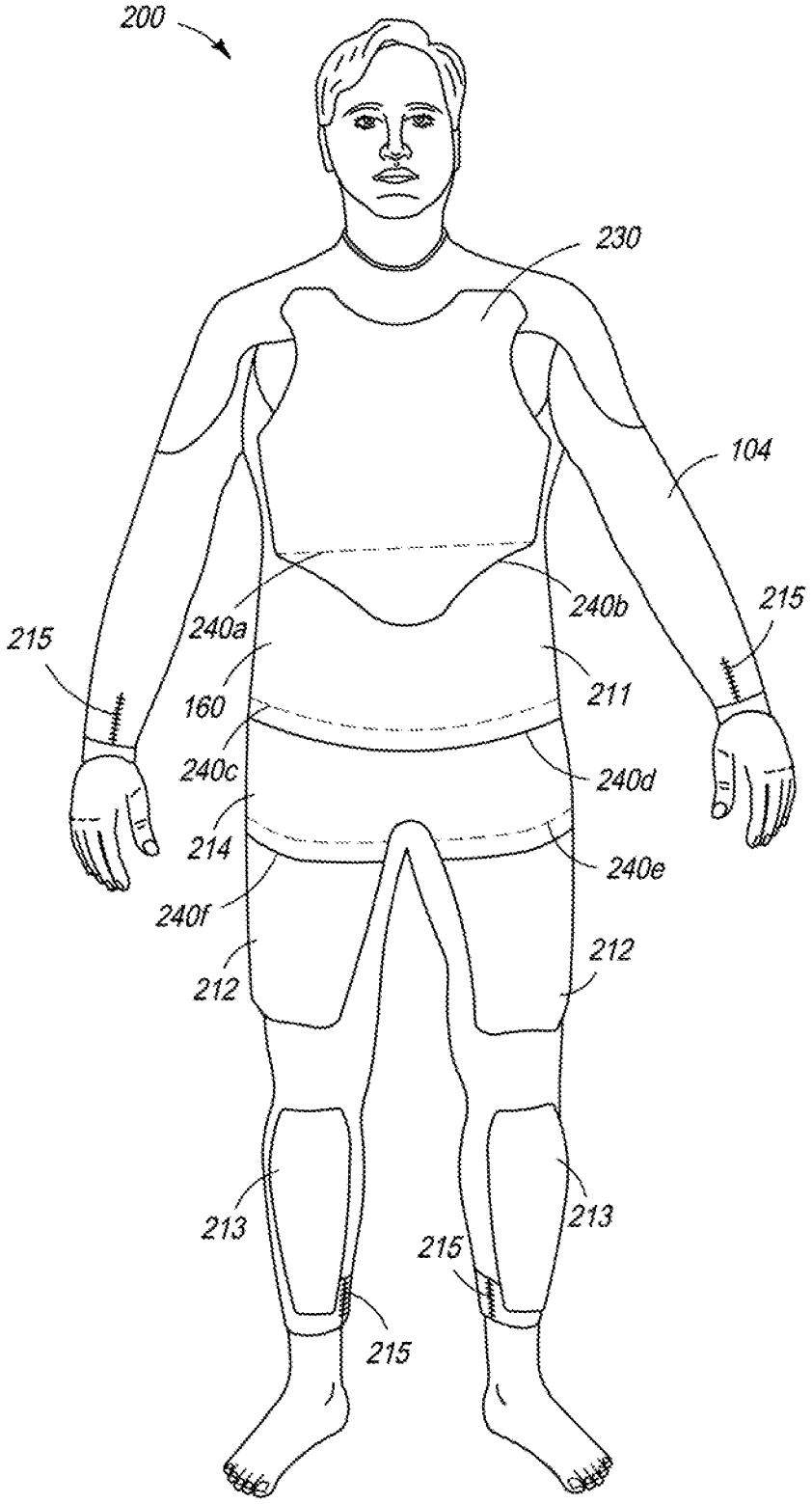
FIG. 6 is a front view of a body surfing suit in an embodiment with segmentations in accordance with the invention.

FIG. 6 depicts an embodiment of a segmented body suit 200. The segmented body suit 200 features segmentations which may act as buoyancy elements, planning elements, or control surfaces on designated areas. In some embodiments, the segmentations are attached to the body 160 of the suit. The segmented body suit 200 may have one or more segmentations attached to it. In some embodiments, the segmented body suit 200 may include a flat front and no sculpted control surfaces such as fins. In some embodiments, the segmented body suit 200 may include raised surfaces, or sculpted control surfaces such as anterior thigh fins (not shown). Segmentations generally curve to conform to various underlying anatomical body parts. An individual segmentation may be constructed to attach to the underlying body suit and suspend over the underlying body suit on one end of the segmentation. In some embodiments, the entire segmentation may be attached to the underlying body suit. As shown in the figure, the segmented body suit 200 may comprise a chest/thorax segmentation 230, abdomen segmentation 211, pelvic segmentation 214, thigh segmentations 212, and lower leg segmentations 213. In some embodiments, the thigh segmentations 212 and the lower leg segmentations may be separate independent segmentations. In some embodiments, the segmented body suit 200 may include a back segmentation, arm segmentations, or lower leg segmentations. Segmentation allows for flexibility and movement of the underlying anatomy or anatomic segment.

In some embodiments, a segmentation may overlap over another adjacent segmentation, such as chest segmentation 230 overlapping over abdomen segmentation 211. This may be indicated by articulation lines 240, 240*a*, 240*b*, 240*c*, 240*d*, 240*e*, and 240*f*, as shown in FIG. 6. In other embodiments, the segmented body suit may be made from a soft and semi-flexible material such as Neoprene®, Lycra®, ethylene vinyl acetate (EVA) foam, cross-linked polyolefin, cross-linked polyethylene foams, elastopolymer or Volara®. In some embodiments, the segmented body suit may be constructed from a hard plastic material.

In embodiments where the segmentations are constructed from a hard plastic material, a floatation foam may be attached to the neoprene suit underneath the segmentations. The floatation foam may be attached to the outside or inside of a body surfing suit. The floatation foam may also be placed into pockets within the body surfing suit to attain a desired buoyancy by altering the thickness of the buoyant material. In embodiments where the segmentations are constructed from a semi-flexible material such as EVA, then the buoyancy may already be built into the segmentations due to the physical characteristics of the foam. In some embodiments, the material between segmentations may be thinner to allow for additional flexibility during bending of the body.

As shown in FIG. 6, articulation lines 240 may indicate the divisions of the segmentations of the segmented body suit 200. The articulation lines 240 may represent the areas where two segmentations meet. For purposes of illustration, the placement of articulation lines 240 may be exaggerated. The articulation lines may signify where there may be overlapping of the segmentations of the suit, or represent a space where the underlying suit can move. In some embodiments, chest segmentation 230 overlaps abdominal segmentation 211 which overlaps pelvic segmentation 214 which overlaps thigh segmentation 212. As shown in the figure, dotted articulation lines may indicate overlapping segmentations. For instance, the lower boundary of abdominal segmentation 211 may be represented by lower abdominal articulation line 240*d* and the upper boundary of pelvic segmentation 214 may be represented by upper pelvic articulation line 240*c*. In this embodiment, abdominal segmentation 211 overlaps pelvic segmentation 214 and thus the upper boundary of pelvic segmentation 214 is beneath pelvic segmentation 214 as shown by a dotted upper pelvic articulation line 240*c* above lower abdominal articulation line 240*d*.

Figure 7:
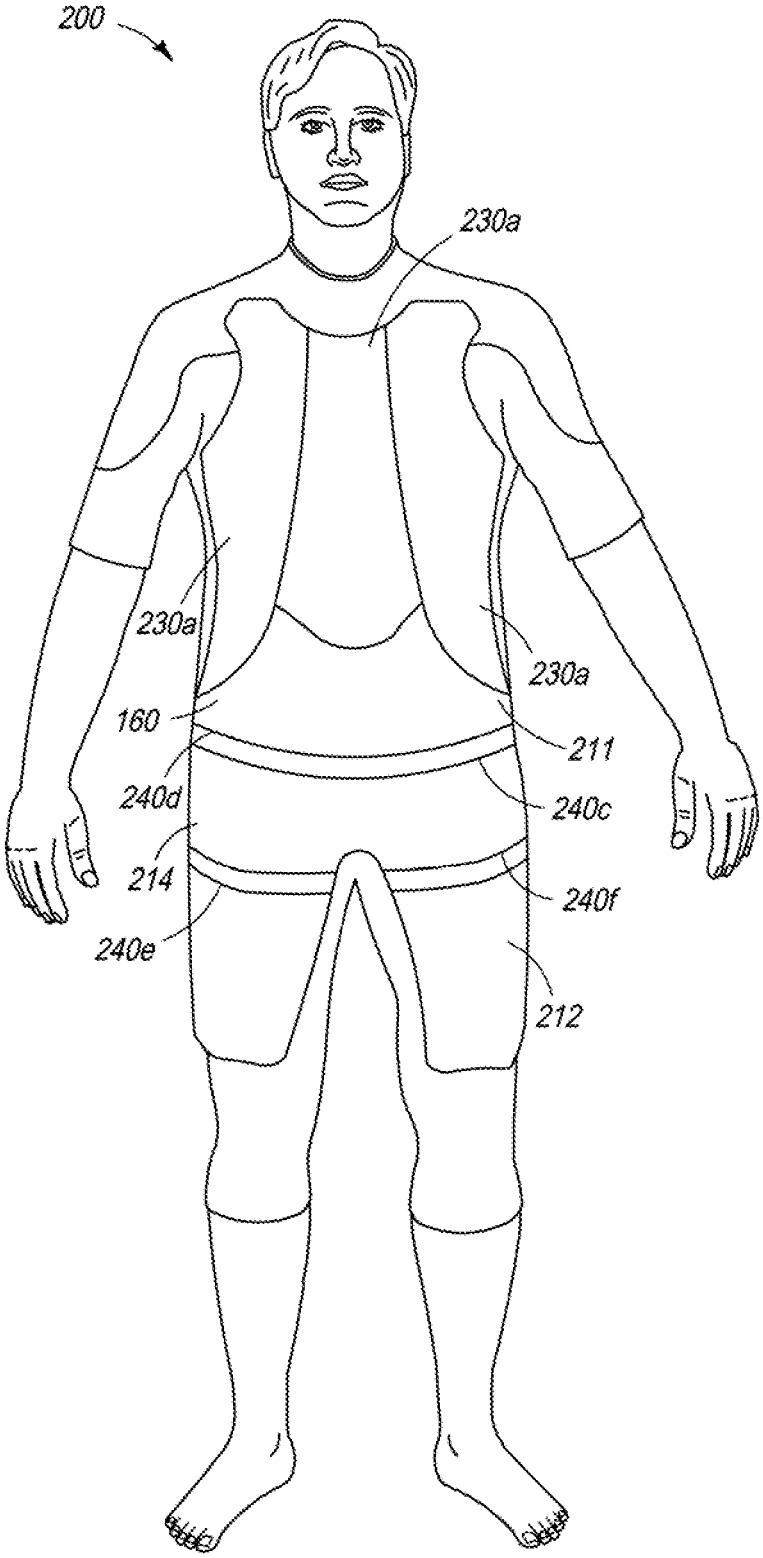
FIG. 7 is a front view of a body surfing suit in an embodiment with horizontal and vertical segmentations, short sleeves and legs in accordance with the invention.

In some embodiments, as shown in FIG. 7, adjacent segmentations may be spaced apart. For instance, there may be a gap between abdomen segmentation 211 and pelvic segmentation 214 which may provide room for movement and flexibility of the segmentations due to bending of the body. As shown in the figure, a gap may form between the lower boundary of abdominal segmentation 211 (represented by lower abdominal articulation line 240*d*) and the upper boundary of pelvic segmentation 214 (represented by upper pelvic articulation line 240*c*).

The articulation lines 240 may be located where bending of the user occurs, such as the bending between the abdomen and the chest. In certain embodiments, the segmentations may act like fish scales where the segmentations slide over each other when the body bends. The segmentations may also pull forward and allow for bending and flexibility which helps the user to catch onto a wave and propel the user in certain directions. In some embodiments, the segmentations are flat and mainly provide buoyancy and a flat planning surface. In other embodiments, the segmentations feature a raised surface which provides a directional control surface.

In some embodiments, each individual segmentation is its own component made separately and then assembled in a factory or put on by the user. Each individual segmentation may be an independent functional unit and then combined with other segmentations to form a larger unit structure. A segmentation may feature a flat surface or may feature a 3-D contour with a concave or convex surface. In some embodiments, segmentations may range in area from 2 $mm^2$ to 1500 $mm^2$. Zippers 215, as shown in FIG. 6, may be used in some embodiments to close up the bottom end of the legs or arms.

Figure 8:
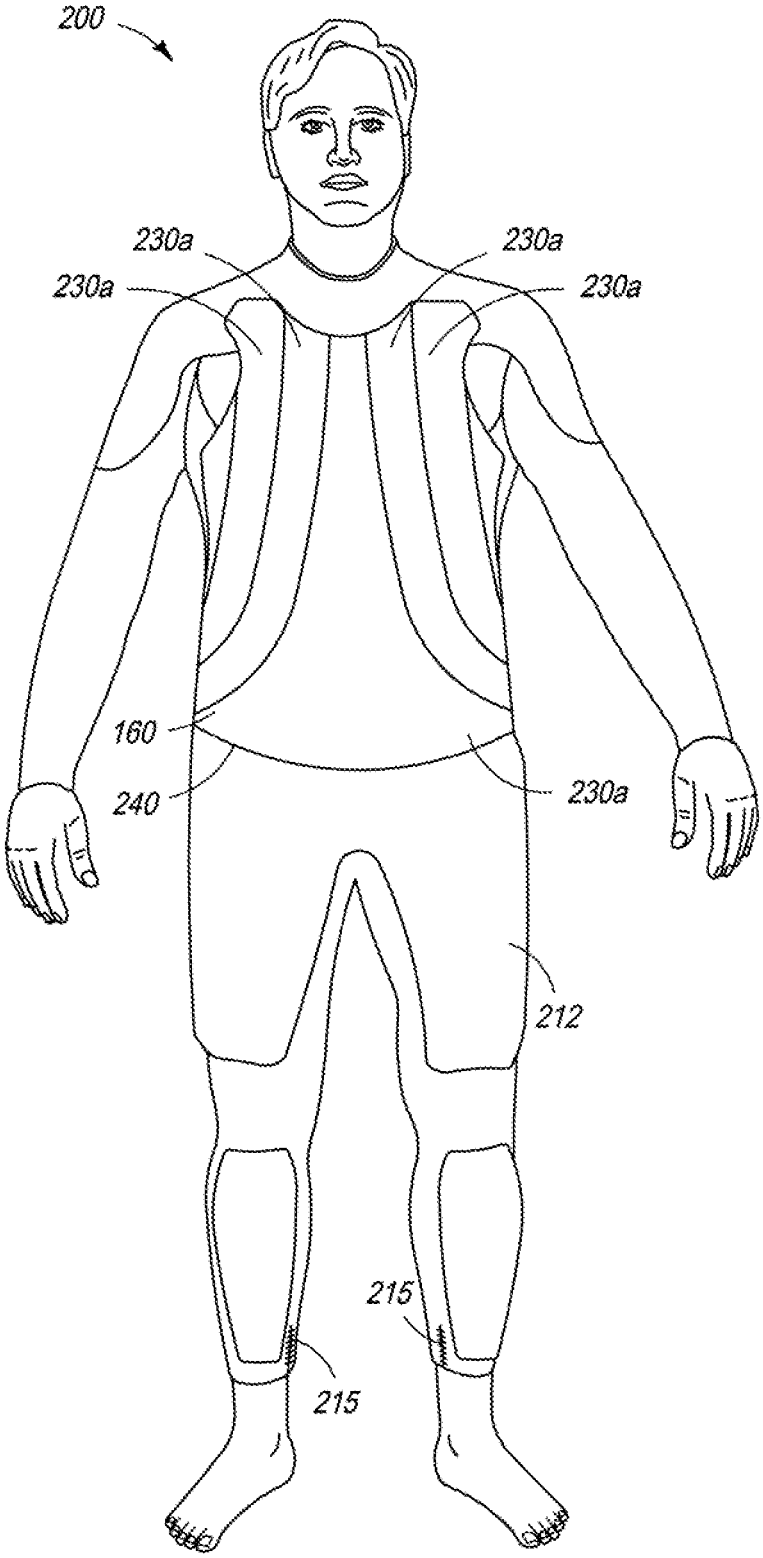
FIG. 8 is a front view of a body surfing suit in an embodiment with horizontal and vertical segmentations in accordance with the invention.

FIG. 7 depicts another embodiment of the segmented body suit 200. As shown in the figure, the segmented body suit contains vertical and horizontal segmentations. The chest segmentation may be divided into three vertical chest segmentations 230*a*. The vertical chest segmentations 230*a* may provide for more control and maneuverability as compared to one single piece chest segmentation. FIG. 8 depicts a similar embodiment as FIG. 7 but with five vertical chest segmentations 230*a*. The segmentations may be complex 3-D contouring along the front, back, and sides of the surfing suit. The segmentations may also revolve circumferentially around each limb and the entire body.

Figure 9:
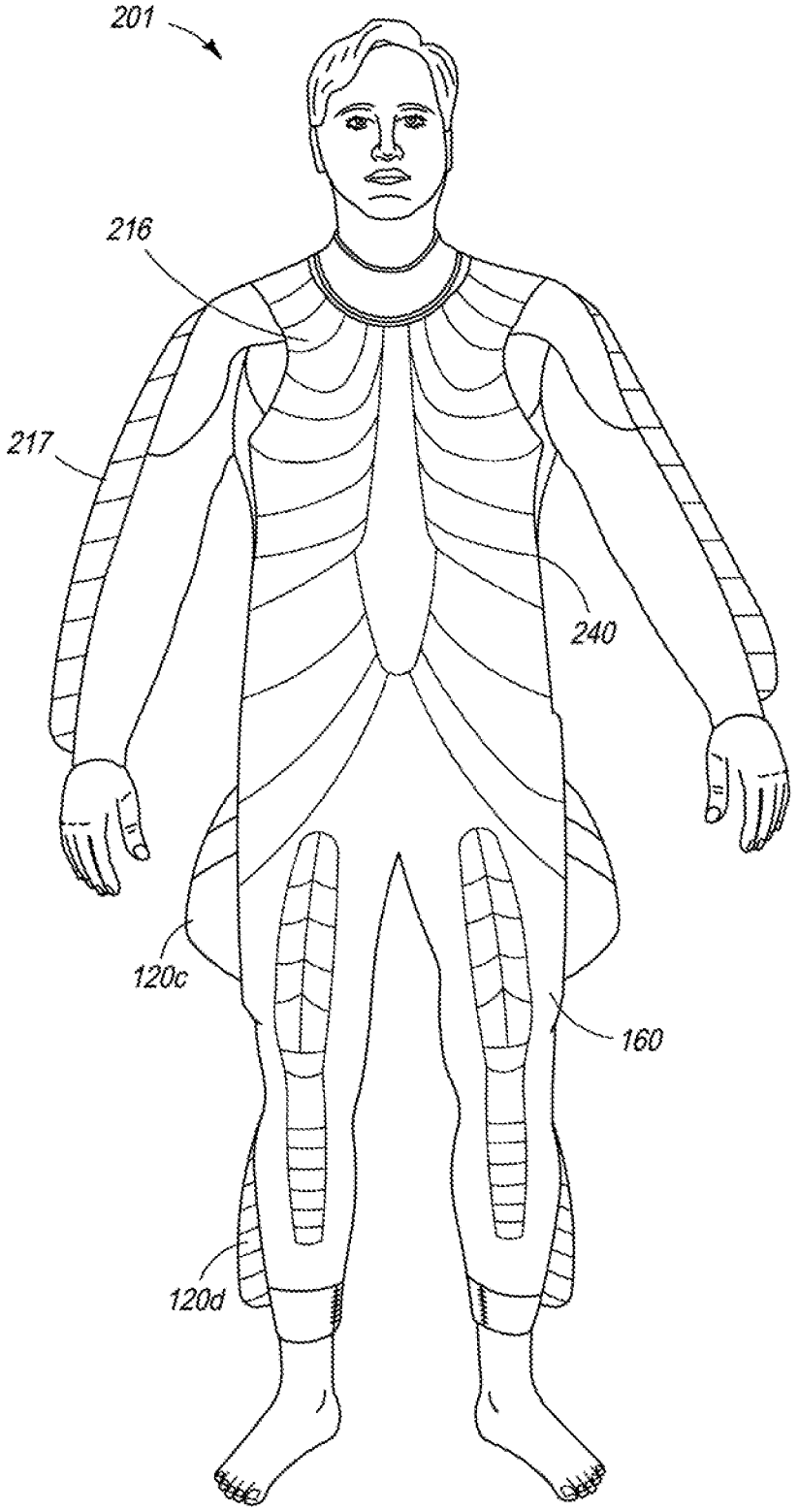
FIG. 9 is a front view of a body surfing suit in an embodiment with mosiac segmentations in accordance with the invention.
Figure 11:
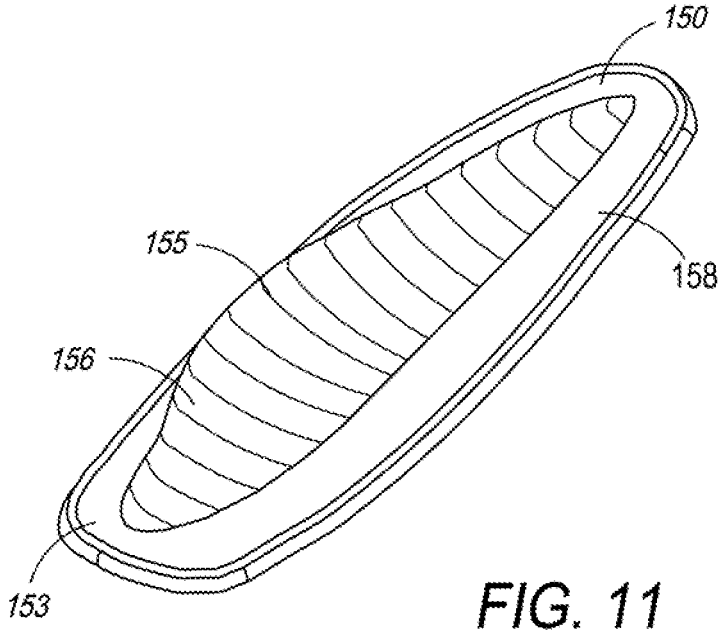
FIG. 11 is an embodiment of a fin with sliced cuts for a body surfing suit in accordance with the invention.

FIG. 9 depicts an embodiment of a mosaic segmented body suit. As shown in the figure, the mosaic segmented body suit 201 may consist of many mosaic segmentations 216 that travel in the vertical direction, horizontal direction, or both. This suit may also include hydrodynamic contoured fins and rails such as upper lateral leg fins 120*c* and lower lateral leg fins 120*d*. In some embodiments, arm mosaic segmentations 217 may travel in vertical, horizontal, or both directions along the arms. The mosaic segmented body suit 201 may contain many overlapping segments indicated by articulation lines 240. The mosaic segmentations 216 may act like fish scales and pull in the direction of the current. Furthermore, like fish scales, the mosaic segmentations 216 may allow for flexibility and freedom of movement, even though they may cross two or more functional anatomic segments. These segments may be attached to an underlying body suit, such as, but not limited to, a Neoprene® suit, at one end and the other side of the segment overlays the next segment and is not adhered to the suit. This may allow the user to maneuver in any direction and propel the user in that direction. Each individual mosaic segmentation 216 may be attached to the underlying body suit by Velcro®, sewing, gluing, or some other attachment means. In some embodiments, mosaic segmentations 216 may be covered with a thin layer of nylon, Lycra®, or a similar material. In some embodiments, the mosaic segmented body suit 201 may include sculpted control surfaces such as, but not limited to, upper lateral leg fins 120*c* and lower lateral leg fins 120*d*. In such embodiments, the upper lateral leg fins 120*c* and/or lower lateral leg fins 120*d* may feature fins with sliced cuts 155 as shown in FIG. 11. In some embodiments as shown in FIG. 11, sliced cuts 155 may extend 2 mm to 300 mm through the blade 156 of the fin 150. In some embodiments, the sliced cuts 155 extend through the blade 156 of the fin 150. The sliced cuts 155 may allow the fin 150 more flexibility when bending.

Overlying mosaic segmentations 216 may partially overlap underlying mosaic segments to allow movement between mosaic segmentations. Mosaic segmentations 216 may be attached in a similar fashion as fish scales are attached on fish where they overlap in one direction and allow water to flow easily and effortlessly in a forward direction. Furthermore, the overlapping mosaic segmentations 216 may aid in hydrodynamic gliding. If water flow is coming against the mosaic segmentations 216 (i.e. "against the grain"), then the mosaic segmentations 216 may open up and cause drag. The mosaic segmentations 216 may be flat or have 3-D anatomy built into them similar to a puzzle, but they may also form a complex 3-D structure. In some embodiments, water may only flow easily in one direction.

The added flexibility combined with the ability to create a contoured segmented 3-D hydrodynamic design with built in buoyancy of the materials used to make the components, may give the user a distinct advantage to catching waves. Propulsion via swimming and reduced drag may also provide further advantages to catching waves.

In some embodiments, the body surfing suit is a short suit wherein the suit cuts off at the knee and just below the elbow (as seen in FIG. 7). In some embodiments, the body surfing suit cuts is ¾ length wherein the suit cuts off halfway between the knee and the ankle, and cuts off halfway between the wrist and the elbow (not shown).

Figure 10:
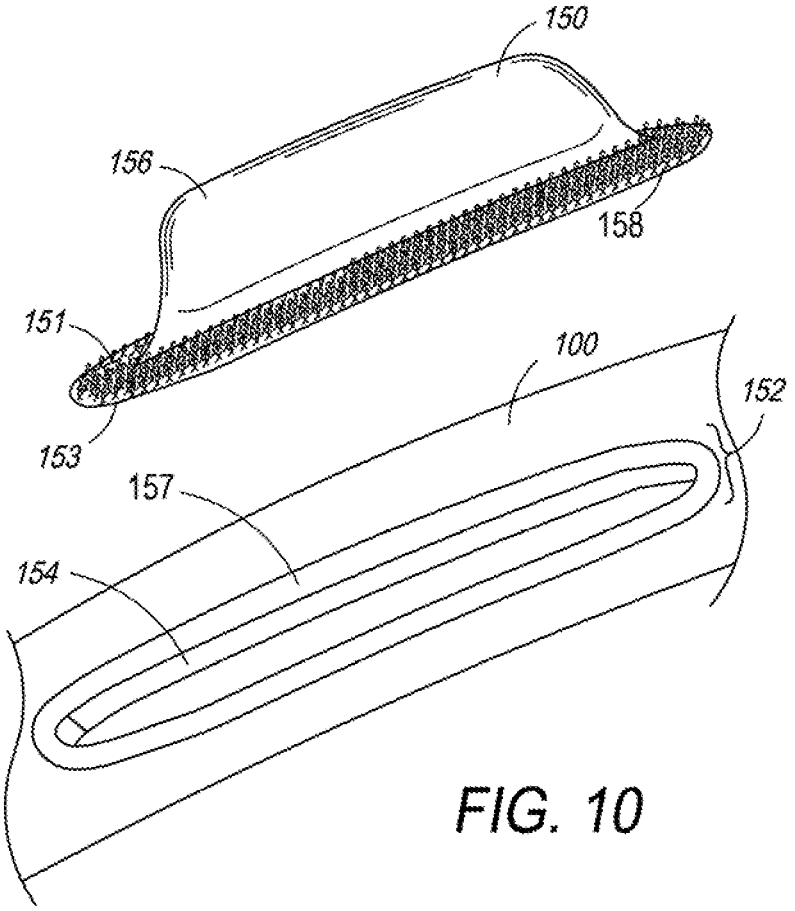
FIG. 10 is an interchangeable fin and depiction of a pocket contained in the body surfing suit in which the fin fits.

FIG. 10 depicts a representation of an interchangeable fin 150 and a pocket 152 within a body surfing suit 100. In some embodiments, the pocket 152 has an outer lining 157 as shown in the figure. In some embodiments, the fins are interchangeable and may be removed and replaced within pockets 152 existing in the body surfing suit 100. In other embodiments, the user may create pockets into an existing body suit and insert interchangeable fins into the pockets. Interchangeable fins 150 could be used for fins 110, 120, 130 displayed in FIGS. 1, 2, 3, 4, 5, 12A-D, etc. The interchangeable fin 150 may be inserted and removed from a hole 154 in the pocket 152. The blade 156 may extend outside of the pocket 152 once the interchangeable fin 150 is inserted into pocket 152. These interchangeable fins 150 may be configured to have a platform 153 wherein a blade 156 is affixed to the platform 153. In some embodiments the platform 153 and the blade 156 can be permanently affixed to one another while in other embodiments the platform and blade can be removably attached to one another.

The platform 153 of the interchangeable fin 150 may include a top surface and a bottom surface. The blade 156 may be affixed to the top surface of the platform 153 and may leave a top exterior edge 158 of the top surface of the platform 153 free. The top exterior edge 158 of the top surface of the platform 153 may be configured to be removably attached to the inside layer of a body suit 100. The interchangeable fin 150 may be layered with Velcro® 151 around the top exterior edge 158 of the top surface of the platform 153. The Velcro® 151 may adhere to an inside layer (not shown) of the pocket 152. As known in the art, Velcro® adheres via a "hook and loop" mechanism. In some embodiments, the inside layer of the pocket 152 is composed of a nylon fabric or other loop-type fabric which may act as the "loop". In some embodiments, the inside layer of the pocket 152 may be equipped with "loop material" adhered to the inside of the suit 100. Chest fins, arm fins, and leg fins may all be interchangeable. In some embodiments, the bottom surface of the platform 153 may be attached to the outside layer of a body suit 100 by Velcro®, gluing, sewing, tying, or stapling, or some other attachment means.

In some embodiments, the interchangeable fins 150 are attached by other attachment means such as gluing, sewing, tying, or stapling. In some embodiments, the interchangeable fins 150 may be covered with a fabric, such as, but not limited to, nylon or Lycra®. This covering may protect the surface of the fin from damage and provide a layer for cosmetic design. In some embodiments, fins may be interchanged for other fins of different size, construction, material, or other modifications. Furthermore, fins may be interchanged depending on a variety of factors such as surf conditions or weather conditions. For instance, if the anticipated waves are slower or smaller than usual, wider fins may be interchanged to compensate for the reduction in speed. Moreover, a beginner surfer may begin with wide and forgiving fins, and then interchange them at a later time for more aggressive fins once he feels ready for more advanced surfing. In some embodiments, the interchangeable fin 150 may be constructed from a different material compared to the body surfing suit. This may be useful in situations where the user desires for a different amount of flexibility in the fins. In some instances, the interchangeable fin 150 may be constructed from multiple materials.

If such a suit with interchangeable fins 150, were purchased a set of interchangeable fins 150 would come with the body surfing suit and additional sets of various sizes could be purchased. The body surfing suit 100 would be equipped with a number of pockets 152 to allow the fins to be inserted and adhere to the suit. Other methods besides pockets may be used to affix different sized fins to the suit wherein the fins are externally bonded to the suit in a temporary fashion. In some embodiments, the fins would be inserted from the inside of the body surfing suit so that the exterior of the fin would face outward and form a fin on either the arms, legs or torso of the user. Such an embodiment of the body surfing suit 100 with interchangeable fins 150 would be very beneficial if the user were to potentially want to ride different types of waves. For example the user may want smaller fins with smaller wave conditions; while in bigger wave conditions the user might want to change out the fins and place in larger interchangeable fins 150. In this embodiment of the body surfing suit 100 the user could buy various sizes of fins to be utilized with the suit.

FIG. 11 depicts an embodiment of an interchangeable fin 150 with sliced cuts 155. In some embodiments, the sliced cuts 155 may extend a certain depth through the blade 156 of the fin 150. The depth of the sliced cut 155 may range from 2 mm to 300 mm. In some embodiments, the sliced cut 155 may extend all the way through the blade 156. In such embodiments, the sliced cuts 155 divide the fin 150 into segments which may be individually attached to an underlying layer or to the body surfing suit. Individual sliced cuts 155 may be attached and assembled to form a final 3-D shape. The sliced cuts 155 may allow the fin 150 more flexibility when bending. Sliced cuts 155 may be featured in any of the above mentioned fins. Sliced cuts 155 may be used in general to areas where buoyancy elements or control surfaces cross functional anatomic segments to provide increased flexibility in those areas.

Figure 12A:
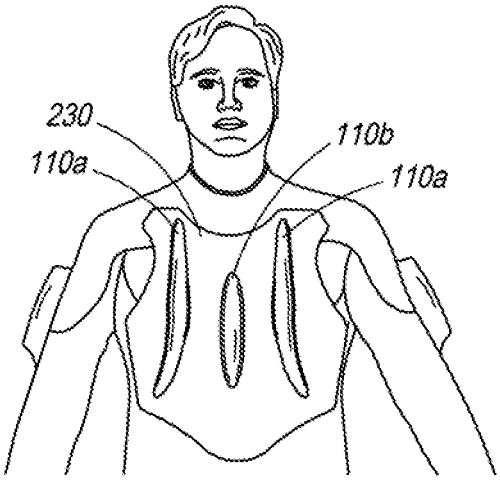
FIG. 12A is a front view of the torso and arms of a body surfing suit in the embodiment with multiple chest fins on a chest segmentation and multiple arm fins in accordance with the invention.
Figure 12B:
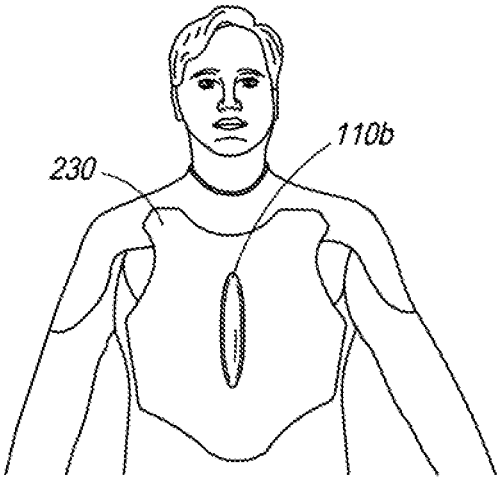
FIG. 12B is a front view of the torso and arms of a body surfing suit in an embodiment with a single chest fin on a chest segmentation in accordance with the invention.
Figure 12C:
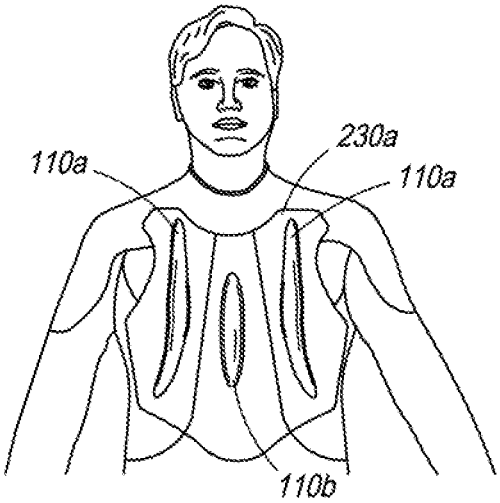
FIG. 12C is a front view of the torso and arms of a body surfing suit in an embodiment with multiple chest fins on multiple chest segmentations in accordance with the invention.
Figure 12D:
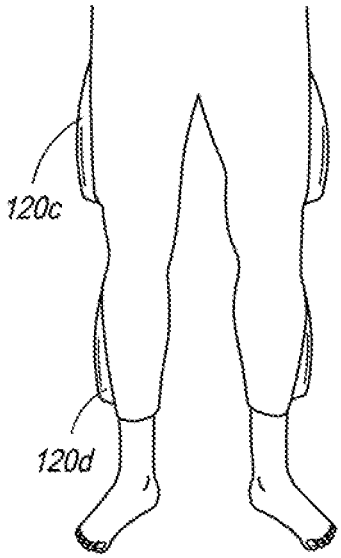
FIG. 12D is a front view of the legs of a body surfing suit in an embodiment with upper and lower lateral leg fins in accordance with the invention.

FIG. 12A-D depict representations of various embodiments of the body surfing suit. FIG. 12A depicts an embodiment with two lateral chest fins 110*a* and one center chest 110*b* on chest segmentation 230 wherein the two lateral chest fins have a complex contoured shape across the chest and ribcage. FIG. 12B depicts an embodiment with one single chest fin 110*b* on chest segmentation 230 without any arm fins. FIG. 12C depicts an embodiment with three vertical segmentations 230*a*, two lateral chest fins 110*a*, and one center chest fin 110*b* on vertical chest segmentations 230*a* without any arm fins. FIG. 12D depicts an embodiment of the upper lateral leg fins 120*c* and lower lateral leg fins 120*d*.

Figure 13:
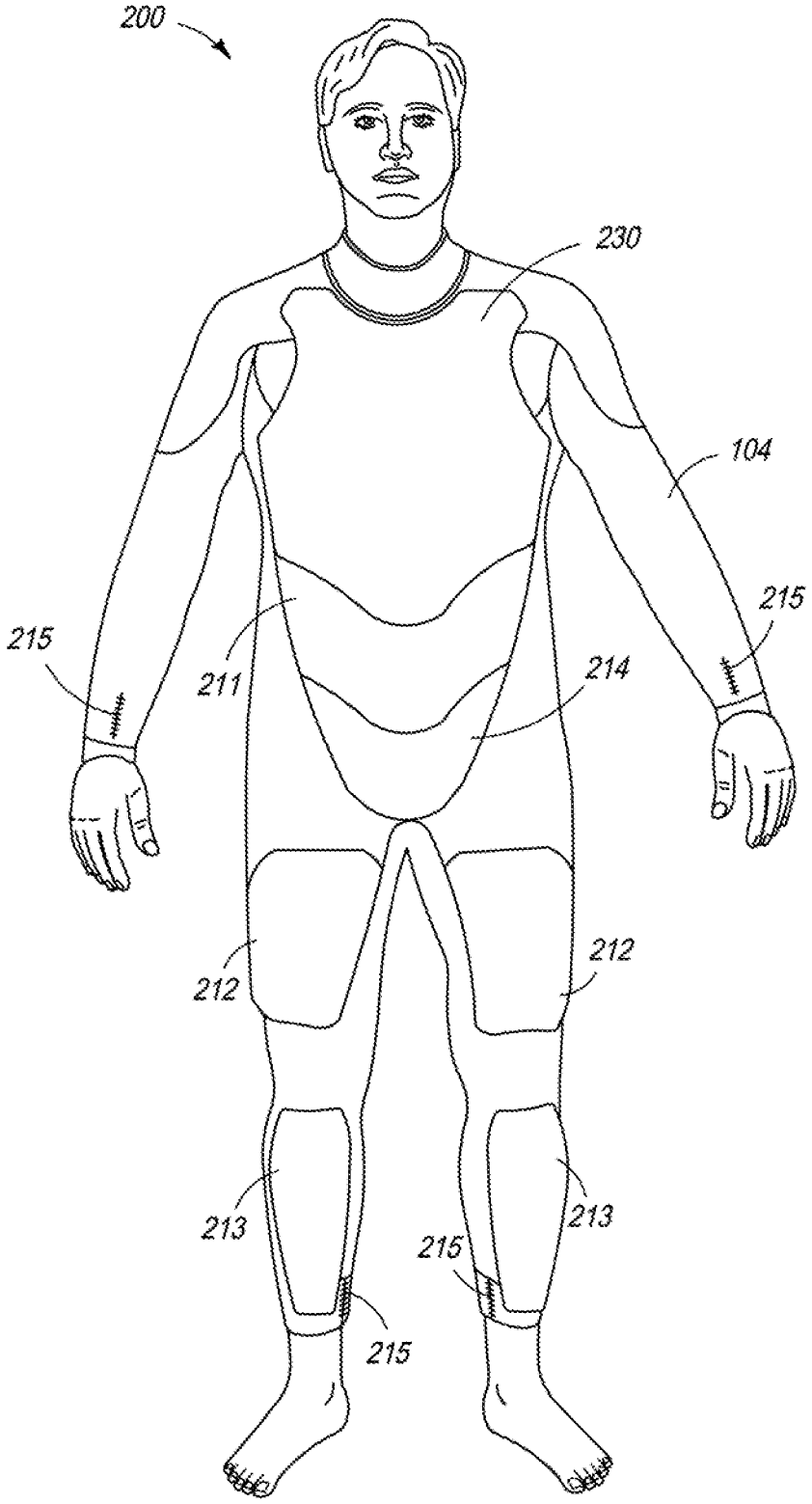
FIG. 13 is a front view of another embodiment of a segmented body suit in accordance with the invention.

FIG. 13 depicts an embodiment of a segmented body suit 200 similar to FIG. 6. The segmented body suit 200 features segmentations which may act as buoyancy elements, planing elements, and/or control surfaces on designated areas. In some embodiments, the segmented body suit 200 may include a flat front and no sculpted control surfaces such as fins. In some embodiments, the segmented body suit 200 may include sculpted control surfaces such as anterior thigh fins (not shown). Segmentations generally curve to conform to various underlying anatomical body parts. An individual segmentation may be constructed to attach to the underlying body suit and suspend over the underlying body suit on one end of the segmentation.

Figure 14:
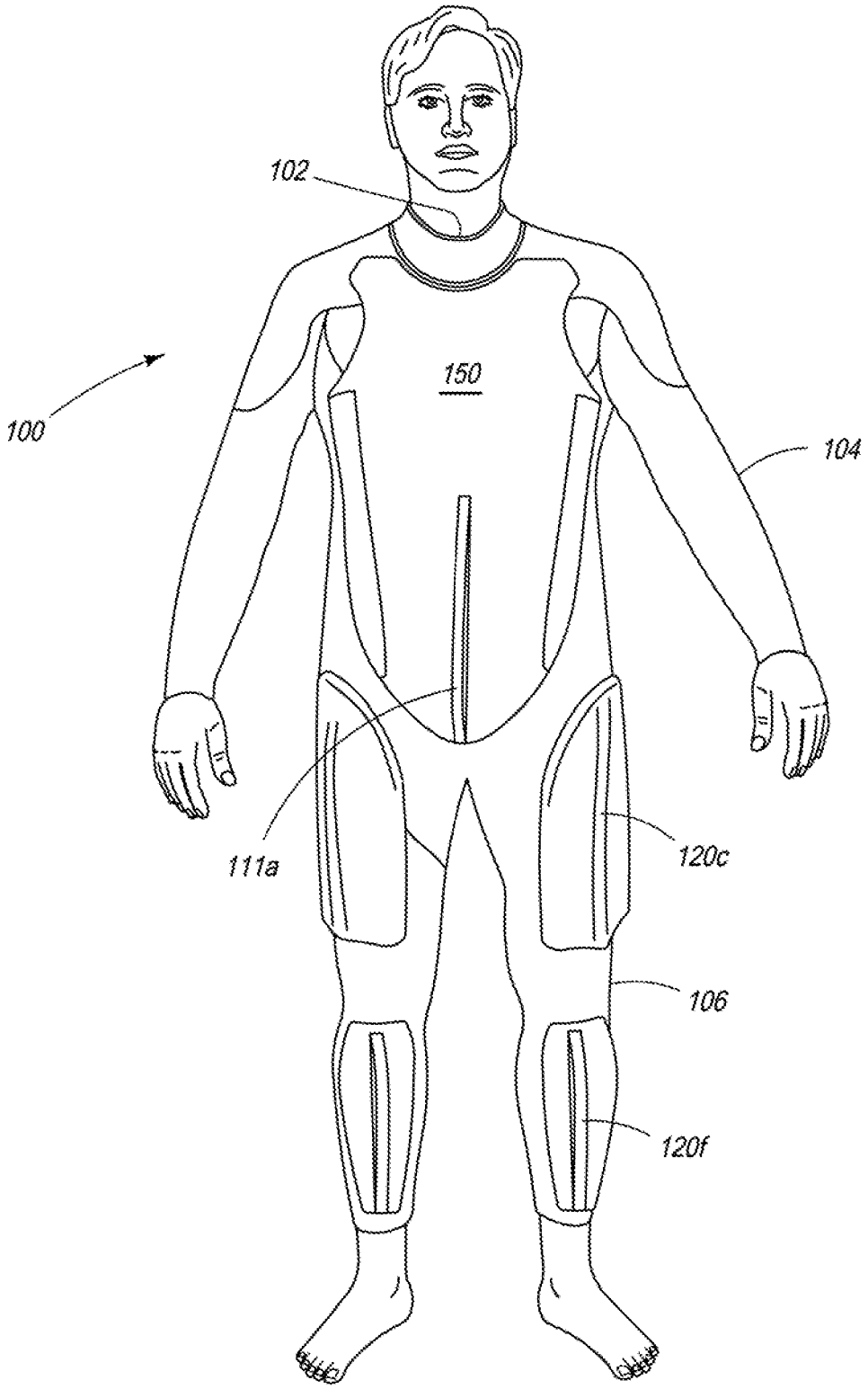
FIG. 14 is a front view of a segmented body suit in an embodiment with an abdominal fin and multiple leg fins in accordance with the invention.

FIG. 14 depicts a representation of a body surfing suit with an abdominal fin 111*a*. In some embodiments, there is more than one abdominal fin (not shown). The abdominal fin 111*a* may be located in the abdominal region and in some embodiments may extend into the chest region. In some embodiments, the abdominal fin 111*a* extends from the xyphoid process to the pelvic inlet. If the abdominal fin 111*a* extends into the chest region, the abdominal fin may be made very flexible such as via sliced cuts or via a very flexible material. FIG. 14 also depicts an embodiment of upper lateral thigh fins 110*c* and central shin fins 120*f*.

In some embodiments, all of the fins are preferably fabricated from a rigid material such as a glass fiber material or injection molded plastic material. In one embodiment, the fins are fabricated from high density thermoplastic polyurethane material. Alternatively, the fins may be fabricated from a more flexible and buoyant material such as floatation foam. Such floatation foams include, for example, polyvinyl chloride ("PVC"), ethylene vinyl acetate ("EVA"), cross-linked polyethylene, cross-linked polyolefin, and polyurethane. Other materials may include plastic, fiberglass, IXL foam, fiberclad, phuzion, high density polyethylene (HDPE), polystyrene, Volara, elastopolymer, and polyethylene.

In some embodiments, the fins are fabricated using PVC an outer shell or form. These forms would then be able to be filled with a foam material such as polyurethane foam. Filling the form with foam would help in the reduction of unnecessary weight as well as aid in the buoyancy of the surfer in the water.

In other embodiments, the fins will be created out of a flat sheet material, which is then molded or formed. The fins will then be able to be sewn into body suit 100, segmented body suit 200, and mosaic segmented body suit 201, in either the form of pockets or protrusions which stick through openings or slots cut into any of the body suits. Alternately, or in addition, the fins may be sewn on or attached to body suit 100 with an adhesive, or adhered to the suit via any variety of methods.

In some embodiments, suit 100 has a gradually tapering thickness (circumferentially) of buoyant foam material (e.g., buoyancy layer) which will begin with a thickness of 1-75 millimeters at the ankle region and increase up to 5-100 millimeters at the shoulder or sternum region. In some embodiments, there will be areas laterally as well as on the abdominal region which will be fin-like. Preferably, all of these areas will smoothly contour and blend into the suit 100, making it as seamless as possible.

In some embodiments, the buoyancy layer is covered with a drag reducing layer. The drag reducing layer may be produced by dipping, painting, spraying, or applying PVC or some other drag reducing flexible material onto the buoyancy layer.

In some embodiments, the lateral and center chest fins, leg fins, and back fins have a hardness between 20-25 durometers (Shore scale). In some embodiments, the leg and arm fins have a hardness between 30-40 durometers.

Processing

In some embodiments, the body surfing suit may be manufactured by injection molding or compression molding. Fins may also be manufactured by injection molding or compression molding. In some embodiments, the body surfing suit or the fins may be manufactured utilizing 3-D printing technology. Injection molding consists of high pressure injection of thermoplastic polymers such as polychloroprene (which forms Neoprene®) into a mold which shapes the polymer into the desired shape. The thermoplastic polymers are melted until soft enough for injection into a mold and after injection the molded shape is cooled, hardened, and ejected from the mold. Molds can be single cavity or multiple cavities. In multiple cavity molds, each cavity can be identical and form the same parts or can be unique and form multiple different geometries such as different fin structures in a single cycle. Molds are generally made from tool steels, but stainless steels molds, aluminum molds, or wood molds may be suitable for certain applications.

Compression molding is a forming process in which a plastic material is placed directly into a heated metal mold, then is softened by the heat, and forced to conform to the shape of the mold as the mold closes.

In some embodiments, the processes which will be utilized and best fitted for this type of product are thermoforming and station filling. Thermoforming starts when a sheet of extruded plastic material of specified thickness goes into a heater or heating area. Hot plates, arranged about 6 inches away from both the top and bottom of the sheet, heat the plastic to make it soft. After the plastic is soft it is removed out of the heating area by an automated, timed carrier. Next, an aluminum mold with the profile of the product desired rises up from underneath the sheet. The mold is raised to where the sheet is actually touching the outermost edge of the mold. Next, vacuum pressure is applied through many tiny holes in the mold. This vacuum pressure pulls the hot plastic sheet material down onto the contours of the mold to form the shape of the part. The hot plastic is left on the mold to cool. Some molds have water channels running through them to help cool the part faster. After cooling, air is blown up through the small vacuum holes to release the plastic part off of the mold. Since the part was first molded out of a sheet of plastic, more than likely the part will have to be trimmed.

This trimming process can be done in several different ways. The molds which would be created for this type of setting would be a family mold which would allow for several parts or forms to be created in a single cycle. The mold would be a family mold which contains several parts which when a single sheet of plastic is heated and formed around the tool would create several usable parts out of one cycle of the machine. This thermoforming process would be the desired process to create the forms or parts which are to be either sewn into or inserted into the wetsuit which will later be filled with a urethane style foam.

Another step in the creation of the suit may be to fill the PVC forms with a foam to help reduce the weight of the suit as well as help enhance the buoyancy of the suit. Any material has the capabilities of being created into a foam. Foam is made by mixing a number of chemicals and adding a "gassing agent" that makes bubbles that make the plastic cellular. The most commonly used foam is urethane foam. This type of foam is man-made and is capable of being created in a wide range of densities. This filling process would be done by an automated system which allows for the resin and the catalyst to be injected into a mold, or in this case the PVC form, in the correct amounts. This type of mixing is known as impingement. Impingement is simply defined as the mixing of the molecules via air born injecting of both the resin and catalyst. For example, a reaction injection molding (RIM) machine could be used for the impingement process.

In RIM, once the material is in the mold, the blowing agents begin to react and cause a foaming procedure to occur. This in turn creates the foam material as desired. Once the tack time, or the time for a specific material to lose the tackiness to touch feeling, the part will be able to be removed from the mold and allowed to further complete the curing process. Those of ordinary skill in the art will realize that the process described herein for processing the present suit is for exemplary purposes only. Any process capable of producing the present suit may be used.

In some embodiments, fins may be covered with a fabric, such as, but not limited to, nylon or Lycra®. This covering may protect the surface of the fin from damage and provide a layer for cosmetic design.

Benefits realized from a body surfing suit made in accordance with the present invention include the following:

(1) Typically, when body-surfing without any suit at all, the surfer needs mobility and freedom of movement before and during the moment of catching a wave. Once the wave is caught, the surfer uses his body muscles to make himself rigid. These same principles need to be followed when designing a suit, and the suit and must allow full flexibility and freedom of movement. The present suit has been designed in that way; in all anatomic areas of movement (arms, legs, waist, trunk, etc) the material has been contoured, tapered, feathered and reduced between functional movable anatomic segments to allow for complete freedom of movement.

(2) The present suit may have smooth 3-D contours which conform to the human anatomy, allowing bending, yet enhancing it with fin-like projections (e.g., similar to the dorsal fin on a marine animal), which provides stability as well as buoyancy.

(3) The present suit may have bilateral fin-like rails that start up near the shoulder region and proceed downward and laterally end at the base of the ribcage. These rails may be longer and extend down into the abdomen, or even all the way down the lateral side of the body, as long as the material is flexible enough. If not, the rails may need to be segmented where they cross functional anatomic segments to provide for freedom of movement. These fins provide stability (to prevent yaw and roll), buoyancy and make the human body more streamlined in the water.

(4) The present suit may have a central chest fin or keel which aids in stability similar to that on a surfboard.

(5) The present suit may have buoyant material enveloped around the entire upper body. In some cases, the buoyant material envelopes the suit circumferentially, like a sea mammal.

(6) The present suit may have upper and lower lateral leg fins, as well as foot fins. In some cases, the leg fins are positioned in the lateral thigh and lateral calf regions, providing stability and more lateral surface area for propulsion when the legs are kicked, increasing the volume of water displaced with each kicking stroke (kind of like swim fins but out to the side of the leg). In some cases, the lateral fins on the feet provide greater surface area for propulsion with each kicking stroke. The lateral positioning of these foot fins allows the surfer to be able to walk without tripping due to the lateral position of the fin. Another feature of the foot fins is that they have small anterior fins/projections (on top of the foot) which act as keel-like stabilizers for directional control similar to a rudder on a boat.

(7) The present suit may have no edges and be smooth in all transition areas to reduce drag. For example, the present suit may have all of the edges (edge detail) where fins attach as smooth and feathered down exactly to the contour of the body so the edges disappear into the suit. As is easily appreciated, it is desirable to reduce drag to the lowest possible tolerance for optimal performance.

(8) The present suit may compliment and enhance the human anatomy for optimal streamlined performance in the water with unimpeded mobility. For example, it may be designed to enhance the thrust and water displacement during the kicking/swimming stroke to maximize propulsion. It may be super slick with seamless (e.g., as seamless as possible) transitions to reduce drag to the bare minimum. The present suit may take a clumsy land animal (human) with all of it's inherent anatomic deficiencies for locomotion in the water, augment it's anatomy without restricting movement, and turn it into a slick marine mammal for catching and riding waves better.

(9) The present suit may have buoyancy up as far forward toward the head as possible, with a decreasing gradient of buoyancy the farther toward the feet you go (buoyancy highest at head and lowest at the feet). Thus, the present suit may put the bulk of buoyant material up near the shoulders or sternum (head region) to limit/reduce the chance of plowing.

In a preferred embodiment, the chest fins of the body surfing suit are designed to avoid interference with a user's swimming stroke. The most common swimming stroke is the "front crawl" swimming stroke. The swimmer starts on the stomach with both arms stretched out to the front and both legs extended to the back. The arm movements of the front crawl provide most of the forward motion. The lateral chest fins, in some embodiments, are curved around the axis of rotation of the shoulder at the top of the chest to avoid interference and impinging of all rotational and functional movement of the arm movements at the shoulder.

The arms alternate from side to side, so while one arm is pulling and pushing under the water, the other arm is recovering above the water. From the initial position, the arm sinks slightly lower and the palm of the hand turns 45 degrees with the thumb side of the palm towards the bottom, to catch the water and prepare for the pull. The pull movement follows a semicircle, with the elbow higher than the hand, and the hand pointing towards the body center and downward. The semicircle ends in front of the chest at the beginning of the ribcage. As the hand pulls past the ribcage for the recovery motion, it is important for the lateral chest fins to not interfere with the hand. The lateral chest fins 110*a* spread anteriorly downward across the chest over the pectoral region on downward then proceed laterally underneath the arm following the contour of the ribcage where they terminate on the side of the body at the lowest extent of the ribcage. This may be designed so as to not interfere with the hand stroke and to bend accordingly with the user. Furthermore, bending of the chest while performing the pull movement may cause the chest fins to bend downwards into the abdomen. This may interfere with bending or tucking of the body while trying to catch a wave. It may be important for the lateral chest fins 110*a* to follow a contoured curvature splayed towards the side of the body so that during the pull movement, the lateral chest fins 110*a* bend sideways away from the abdomen and unloads the force of bending onto the side of the body. In some embodiments, the lateral chest fins 110*a* provide a long enough surface to keep the user on a wave, with directional control to grab and hold on the wave, with enough buoyant material to float making it easier to catch the wave, and without limiting the tucking or bending motion necessary to safe swimming. It may be critical to be able to tuck or bend when riding waves so that the force of the wave will not be directed to the pelvis or the neck. If the force is distributed to the neck, the neck may be damaged.

The above description of disclosed embodiments is provided to enable any person skilled in the art to make or use the invention. Various modifications to the embodiments will be readily apparent to those skilled in the art; the generic principals defined herein can be applied to other embodiments without departing from spirit or scope of the invention. For example, in some embodiments, body surfing suit 100 is a short suit, meaning that legs 106 end above the surfer's knees. In such an embodiment, there may be only one set of fins 120 located on the legs 106 of suit 100. Thus, the invention is not intended to be limited to the embodiments shown herein but is to be accorded the widest scope consistent with the principals and novel features disclosed herein.

What is claimed is:

1. A segmented body suit comprising:

a suit body including a torso region, a first arm region, a second arm region, a first leg region, and a second leg region;

wherein the torso region includes a chest region, an abdominal region, a pelvic region, and a back region;

a plurality of segmentations including a first segmentation configured to attach to the suit body and curved to conform to a first underlying anatomical body part and a second segmentation configured to attach to the suit body and curved to conform to a second underlying anatomical body part, wherein the plurality of segmentations including:

a chest segmentation made of a buoyant material and including a lower end and an upper end, wherein the upper end is attached to the chest region of the suit body; and at least one of:

an abdominal segmentation made of a buoyant material and including a lower end and an upper end, wherein the upper end is attached to the abdominal region of the suit body, a pelvic segmentation made of a buoyant material and including a lower end and an upper end, wherein the upper end is attached to the pelvic region of the suit body, and a thigh segmentation made of a buoyant material and including a lower end and an upper end, wherein the upper end is attached to the thigh region of the suit body; and one or more fins attached to at least one of (i) the plurality of segmentations and (ii) the suit body, wherein the one or more fins comprises at least:

a center chest fin including a blade attached to the chest segmentation, the center chest fin extending down the chest region, and ending above the abdominal region, and first and second lateral chest fins attached to the chest segmentation and located on opposite sides of the central axis and each comprising an elongate, arcuate blade extending down the chest region with a convex side of each elongate, arcuate blade facing the center chest fin.

2. The segmented body suit of claim 1, wherein the one or more fins comprises at least one fin attached to the suit body.

3. The segmented body suit of claim 1, wherein the plurality of segmentations comprises the abdominal segmentation, and wherein the upper end of the abdominal segmentation is overlapped by the lower end of the chest segmentation.

4. The segmented body suit of claim 3, wherein the plurality of segmentations comprises the pelvic segmentation, wherein the abdominal and pelvic segmentations are adjacent and spaced apart to allow for bending between underlying anatomical body parts.

5. The segmented body suit of claim 1, wherein the first and second segmentations are adjacent and spaced apart to allow for bending between the first and second underlying anatomical body parts.

6. The segmented body suit of claim 1, wherein a lower end of the chest segmentation includes a raised surface.

7. The segmented body suit of claim 1, wherein each segmentation of the plurality of segmentations is composed of at least one of: plastic, fiberglass, ethylene-vinyl acetate (EVA), polyvinyl chloride (PVC), IXL foam, fiberclad, phuzion, high density polyethylene (HDPE), polystyrene, polyolefin, Volara, elastopolymer, neoprene material, and polyethylene.

8. The segmented body suit of claim 1, wherein the suit body is composed of at least one of: plastic, fiberglass, ethylene-vinyl acetate (EVA), polyvinyl chloride (PVC), IXL foam, fiberclad, phuzion, high density polyethylene (HDPE), polystyrene, polyolefin, Volara, elastopolymer, and polyethylene.

9. The segmented body suit of claim 1, wherein the second segmentation comprises the abdominal segmentation, and wherein the plurality of segmentations further comprises a pelvic segmentation and thigh segmentation.

10. The segmented body suit of claim 9, wherein the plurality of segmentations further comprises a lower leg segmentation.

11. The segmented body suit of claim 1, wherein each blade includes a blade base and a blade apex.

12. The segmented body suit of claim 1, wherein each blade includes a blade base and a blade apex.

13. The segmented body suit of claim 1, wherein the one or more fins comprises a plurality of chest fins, including the center chest fin and the first and second lateral chest fins, attached to the chest segmentation and extending toward the lower end of the chest segmentation, wherein each chest fin in the plurality of chest fins is individually attached the chest segmentation.

14. The segmented body suit of claim 13, wherein the one or more fins comprises a plurality of fins each including a blade, wherein each blade includes a blade base and a blade apex.

15. The segmented body suit of claim 1, wherein the one or more fins comprise a lateral shin fin located laterally from a shin portion of each of the first and second leg regions.

16. The segmented body suit of claim 1, wherein the plurality of segmentations comprises the thigh segmentation and pelvic segmentation, wherein the thigh and pelvic segmentations are adjacent and spaced apart to allow for bending between underlying anatomical body parts.

* * * * *